US007532546B2

(12) United States Patent
Suzuki et al.

(10) Patent No.: US 7,532,546 B2
(45) Date of Patent: May 12, 2009

(54) TIMEPIECE WITH CALENDAR MECHANISM HAVING DATE INDICATORS FOR INDICATING DATE

(75) Inventors: Shigeo Suzuki, Chiba (JP); Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/511,986

(22) Filed: Aug. 29, 2006

(65) Prior Publication Data

US 2007/0047391 A1 Mar. 1, 2007

(30) Foreign Application Priority Data

Aug. 29, 2005 (JP) ..... 2005-248165
Aug. 28, 2006 (JP) ..... 2006-230116

(51) Int. Cl.
*G04B 19/24* (2006.01)

(52) U.S. Cl. ..... 368/37; 368/28

(58) Field of Classification Search ..... 368/28–40, 368/220–223, 233, 235–236, 196
See application file for complete search history.

(56) References Cited

U.S. PATENT DOCUMENTS 15,637 A * 9/1856 Allen ..... 368/37
347,139 A * 8/1886 Thommen ..... 368/220
3,518,825 A * 7/1970 Nissen ..... 368/37
3,982,388 A * 9/1976 Guyot et al. ..... 368/35
6,081,483 A * 6/2000 Capt et al. ..... 368/28
7,266,050 B2 * 9/2007 Eisenegger et al. ..... 368/37
2006/0002237 A1 * 1/2006 Takahashi ..... 368/28
2006/0098535 A1 * 5/2006 Marki et al. ..... 368/37
2006/0133214 A1 * 6/2006 Suzuki ..... 368/37

* cited by examiner

*Primary Examiner*—Vit W Miska
*Assistant Examiner*—Sean Kayes
(74) *Attorney, Agent, or Firm*—Adams & Wilks

(57) ABSTRACT

A timepiece with calendar mechanism has a time indicator that indicates time by undergoing rotation in accordance with a driving operation of a drive mechanism, and first and second separate and independent date indicators each having date characters and each mounted to undergo intermittent rotation so that combinations of the date characters of the first and second date indicators indicate a units numeral of a date. A third date indicator has date characters and is mounted to undergo rotation for indicating a tens numeral of the date. A program wheel intermittently rotates the first, second and third date indicators in accordance with a driving operation of the drive mechanism.

29 Claims, 25 Drawing Sheets

TIMEPIECE WITH CALENDAR MECHANISM HAVING DATE INDICATORS FOR INDICATING DATE

BACKGROUND OF THE INVENTION

1. Field of the Invention

The present invention relates to a timepiece with a calendar mechanism having plural date indicators for indicating a date. More specifically, the invention relates to an analog timepiece with a calendar mechanism including a first date indicator and a second indicator for indicating a units numeral of a date, and a third date indicator for indicating a tens numeral of a date.

2. Description of the Prior Art (1) Description of Terms:

Generally, a machine body including a drive portion of a timepiece is referred to as "movement". A state of constituting a finished product by attaching a dial, a hand to a movement and putting the movement in a timepiece case is referred to as "complete" of a timepiece. In both sides of a main plate constituting a base plate of a timepiece, a side of providing glass of a timepiece case, that is, a side of providing a dial is referred to as "back side" of a movement or "glass side" or "dial side". In both sides of a main plate, a side of providing a case back of a timepiece case, that is, a side opposed to a dial is referred to as "top side" or "case back side" of movement. A train wheel integrated to "top side" of a movement is referred to as "top train wheel". A train wheel integrated to "bottom side" of movement is referred to as "bottom train wheel". Generally, "12 o'clock side" indicates a side of arranging a graduation in correspondence with 12 o'clock of a dial in an analog type timepiece. "12 o'clock direction" indicates a direction directed to "12 o'clock side" from a rotational center of an indicator in an analog type timepiece. Further, "3 o'clock side" indicates a side of arranging a graduation in correspondence with 3 o'clock of a dial in an analog type timepiece. "3 o'clock direction" indicates a direction directed to "3 o'clock side" from a rotational center of an indicator. Further, "6 o'clock side" indicates a side of arranging a graduation in correspondence with 6 o'clock of a dial in an analog type timepiece. "6 o'clock direction" indicates a direction directed to "6 o'clock side" from a rotational center of an indicator in an analog type timepiece. Further, "9 o'clock side" indicates a side of arranging a graduation in correspondence with 9 o'clock of a dial. "9 o'clock direction" indicates a direction directed to "9 o'clock side" from a rotational center of an indicator in an analog type timepiece. Further, there is a case of indicating a side of arranging other graduation of a dial as in "2 o'clock direction", "2 o'clock side".

(2) Timepiece with Calendar Mechanism of Background Art:

An explanation will be given of a timepiece with a calendar mechanism of a background art including a first date indicator indicating a position of 1 of a date, and a second date indicator indicating a position of 10 of a date as follows.

(2.1) Timepiece with Calendar Mechanism of First Type of Background Art:

In reference to FIG. 26, a timepiece with a calendar mechanism of a first type of a background art includes two date indicators 822, 824 overlapped each other at least partially. The first date indicator 822 provides date indication of a position of 1, and the second indicator 824 provides date indication of a position of 10. The first date indicator 822 is provided with numerals of "0", "1" through "9", that is, 10 pieces of numerals in a circumferential direction. The second date indicator 824 is provided with two sets of numerals from "0" through "3", that is, 8 pieces of numerals in a circumferential direction. A drive mechanism includes a 24 hour indicator 820 rotating by one rotation per 24 hours by rotation of an hour wheel 816, an operating lever 844 operated by rotating the 24 hour indicator 820, and other wheel or the like for control. By operating the operating lever 844, a program wheel 850 is rotated, the first date indicator 822 is rotated by a first date indicator drive wheel 852, and the second date indicator 824 is rotated by a second date indicator drive wheel 854. Rotation of the first date indicator 822 is rectified by a first date indicator jumper 862. Rotation of the second date indicator 824 is rectified by a second date indicator jumper 864 (refer to, for example, Patent Reference 1).

(2.2) Timepiece with Calendar Mechanism of Second Type of Background Art:

In reference to FIG. 27, a timepiece with a calendar mechanism of a second type of a background art includes a 1 position circular disk 932 indicating a position of 1 of a date, and a 10 position circular disk 931 indicating a position of 10 of a date. A 1 pinion 933 is fixed to the 1 position circular disk 932. A 1 position jumper 936 maintains an angular position of a 1 position pinion 933. A 10 position pinion 934 is fixed to the 10 position circular disk 931. A 10 position jumper 940 maintains an angular position of the 10 position pinion 934. The 1 position pinion 933 is brought in mesh with an upper half of a teeth row of a date gear 908. The 1 position circular disk 932 is provided with numerals of "0", "1" through "9", that is, 10 pieces of numerals in a circumferential direction. The 10 position circular disk 931 is provided with two sets of numerals from "0" through "3" and two of "0", that is, 10 pieces of numerals in a circumferential direction. Respective hooks of a drive apparatus 906 are brought in mesh with a teeth row of the date gear 908, thereby, teeth of the date gear 908 are made to advance 1 pitch per 1 day. The 10 position pinion 934 is driven by 1 pitch by an intermediate movable part 937. The intermediate movable part 937 is driven by 1 pitch by the date gear 908 by way of an idle gear 938 (refer to, for example, Patent Reference 2).

(3) Lists of Patent References

[Patent Reference 1] European Patent Application Publication No. 1070996 A1

[Patent Reference 2] JP-A-2000-147148

According to a timepiece with a calendar mechanism of a first type of the background art, a drive mechanism for driving the first date indicator 822 and the second date indicator 824 includes the 24 hour indicator 820, the operating lever 844 and other wheel for control and therefore, there poses a problem that a structure of the drive mechanism is complicated and an area occupied by the drive mechanism is large. Further, according to the timepiece with the calendar mechanism of the second type of the background art, the 10 position pinion 934 is driven by the date gear 908 by way of the intermediate movable part 937 and the idle gear 938 and therefore, there poses a problem that a drive mechanism for driving the 10 position circular disk 931 is complicated and an area occupied by the drive mechanism is large. Further, a timepiece with a calendar mechanism of a background art poses a problem that a drive mechanism is complicated, and a rotational load of the drive mechanism is large. According to a timepiece with a calendar mechanism of a background art, 10 pieces of numerals indicating dates are provided in a circumferential direction of a date indicator and therefore, it is difficult to enlarge a size of numerals indicating the dates.

It is an object of the invention to provide a timepiece with a calendar mechanism that includes three date indicators comprising two date indicators for indicating a position of 1 of a date (i.e., a units numeral of the date) and one date indicator for indicating a position of 10 of a date (i.e., a tens numeral of the date), and a drive mechanism for driving the three date indicators by a compact mechanism having a simple structure. Further, it is another object of the invention to provide a timepiece with a calendar mechanism including a date indicator having a date character which is large and easy to see. Further, it is another object of the invention to provide a timepiece with a calendar mechanism in which a rotational load of a drive mechanism is small.

SUMMARY OF THE INVENTION

The invention is constituted by a timepiece with calendar mechanism for indicating a date by a plurality of date indicators, the timepiece comprising a drive mechanism for driving the timepiece with calendar mechanism, a time indicator for indicating time information by being rotated by operating the drive mechanism, a first date indicator for indicating one portion of a position of 1 of the date, a second date indicator for indicating other portion of the position of 1 of the date, a third date indicator for indicating a position of 10 of the date, and a program wheel constituted to be able to respectively rotate the first date indicator, the second date indicator, and the third date indicator intermittently based on an operation of the drive mechanism. The timepiece with calendar mechanism is constituted such that information with regard to the date can be indicated by one of first date characters provided at the first date indicator and one of third characters provided at the third date indicator, outer peripheral portions of the first date indicator and the third date indicator being positioned to be proximate to each other, further, information with regard to the date can be indicated by one of second characters provided at the second date indicator and one of the third date characters provided at the third date indicator peripheral portions of the second indicator and the third indicator being positioned to be proximate to each other. It is preferable to constitute the timepiece with calendar mechanism such that a rotation center axis line of the first date indicator and a rotation center axis line of the second date indicator are constituted to coincide with each other. By the constitution, the timepiece with calendar mechanism in which the drive mechanism for driving the first date indicator, the second date indicator, the third date indicator is simply and compactly constituted can be realized. Further, by the constitution, the timepiece with calendar mechanism including the date indicators having date characters which are large and easy to see can be realized.

It is preferable to constitute the timepiece with calendar mechanism of the invention such that a rotation center axis line of the program wheel is constituted to coincide with a rotation center axis line of the time indicator. Further, according to the timepiece with calendar mechanism of the invention, it is preferable that the program wheel includes a program date indicator constituted to rotate based on the operation of the drive mechanism, a first program wheel constituted to be able to rotate integrally with the program date indicator and to be able to intermittently rotate the first date indicator, a second program wheel constituted to be able to rotate integrally with the program date indicator and to be able to intermittently rotate the second date indicator, and a third program wheel constituted to be able to rotate integrally with the program date indicator and to be able to intermittently rotate the third date indicator. By the constitution, the timepiece with calendar mechanism constituted compactly can be realized.

The timepiece with calendar mechanism of the invention can be constituted such that the program date indicator includes 31 pieces of teeth portions for receiving the operation of the drive mechanism, the first program wheel includes 18 pieces of teeth portions for rotating the first date wheel, the second program wheel includes 18 pieces of teeth portions for rotating the second date indicator, the third program indicator includes 4 pieces of teeth portions for rotating the third date indicator, the first date indicator includes a first date character indicating face including 5 pieces of numerals aligned in a peripheral direction in an order of "0", "1", "2", "3", "4", the second date indicator includes a second date character indicating face including 5 pieces of numerals aligned in a peripheral direction in an order of "5", "6", "7", "8", "9", and the third date indicator includes a third date character indicating face including 4 pieces of numerals aligned in a peripheral direction in an order of "0", "1", "2", "3" or 3 pieces of numerals aligned in the peripheral direction in an order of "1", "2", "3". Different from a structure of the background art in which 10 pieces of numerals are provided in a circumferential direction, according to the constitution of the invention, a size of the numeral indicating the date of the date indicator can be made to be larger than that of the background art. Therefore, by the invention, the timepiece with calendar mechanism in which calendar indication is large and easy to see can be realized.

According to the timepiece with calendar mechanism of the invention, it is preferable to further comprise an intermediate date driving wheel constituted to rotate based on the operation of the drive mechanism and arranged to overlap the program wheel, a date driving wheel constituted to rotate based on rotation of the intermediate date driving wheel, and a date driving finger constituted to rotate based on rotation of the date driving wheel, wherein the program date wheel is constituted to rotate based on rotation of the date driving finger. By the constitution, the timepiece with calendar mechanism constituted compactly can be realized.

According to the timepiece with calendar mechanism of the invention, it is preferable to further comprise a program date indicator jumper for rectifying rotation of the program date indicator, a first date indicator jumper for rectifying rotation of the first date indicator, a second date indicator jumper for rectifying rotation of the second date indicator, and a third date indicator jumper for rectifying rotation of the third date indicator. By the constitution, rotation of the program date wheel, the first date indicator, the second date indicator, the third date indicator can be rectified simultaneously and firmly.

The timepiece with calendar mechanism of the invention can be constituted to further comprise a calendar correcting mechanism capable of correcting a display content of the first date indicator, a display content of the second date indicator, a display content of the third date indicator by rotating a hand setting stem in a state of pulling the hand setting stem to a hand setting stem position capable of correcting a calendar, wherein the calendar correcting mechanism includes a calendar correcting wheel, and is constituted to be able to rotate the program wheel by rotating the calendar correcting wheel based on rotation of the hand setting stem in a state of pulling the hand setting stem to the hand setting stem position capable of correcting the calendar. According to the timepiece with calendar mechanism of the invention, a train wheel constituting the calendar mechanism can be constituted compactly and by a small number of parts and therefore, a rotational load of the drive mechanism can be reduced.

The timepiece with calendar mechanism of the invention can be constituted such that the program date wheel includes a teeth portion for receiving an operation of the drive mechanism, the first program wheel includes a teeth portion for rotating the first date indicator, the second program wheel includes a teeth portion for rotating the second date indicator, the third program wheel includes a teeth portion for rotating the third date indicator, the first date indicator includes a first date character indicating face including 1 piece or consecutive 2 pieces or more and 8 pieces or less of numerals constituted by aligning numerals of "0", "1", "2", "4", "5", "6", "7", "8", "9" in a peripheral direction and a notch portion for indicating numerals of the second date indicator, the second date indicator includes a second date character indicating face aligned with all of consecutive numerals of the numerals of "0", "1", "2", "3", "4", "5", "6", "7", "8", "9" other than numerals aligned at the first date indicator in a peripheral direction, and the third date indicator includes a third character indicating face including numerals aligned in a peripheral direction in an order of "0", "1", "2", "3" or numerals aligned in the peripheral direction in an order of "1" "2", "3".

Here, consecutive numerals signify that in "1" "2" . . . "9", "0" is consecutive to "9", "1" is consecutive to "0", and "2" . . . "9" are consecutive to "1". For example, in a case of five numerals starting from "8", the numerals include "0" in the midst of "8", "9", "0", "1", "2".

Further, a constitution that the program date wheel includes 31×n (n is a natural number equal to or larger than 1) pieces of teeth portions for receiving the operation of the drive mechanism, and the third date wheel includes a wheel having a number of teeth equal to or smaller than a number of teeth of the first date indicator or the second date indicator can be constructed. Therefore, according to the invention, the timepiece character mechanism having a large calendar indication and easy to see can be realized.

BRIEF DESCRIPTION OF THE SEVERAL VIEWS OF THE DRAWINGS

FIG. 7(*b*) is a plane view showing the second date indicator.

FIG. 13(*a*) is an enlarged partial plane view showing portions of the first date indicator and the first program wheel. FIG. 13(*b*) is an enlarged partial plane view showing portions of the second date indicator and the second program wheel. FIG. 13(*c*) is an enlarged partial plane view showing portions of the first date indicator, the second date indicator, the first program wheel, the second program wheel. FIG. 13(*d*) is an enlarged partial plane view showing portions of the third indicator and the third program wheel;

FIG. 14(*a*) is an enlarged partial plane view showing portions of the first date indicator and the first program wheel. FIG. 14(*b*) is an enlarged partial plane view showing portions of the second date indicator and the second program wheel. FIG. 14(*c*) is an enlarged partial plane view showing portions of the first date indicator, the second date indicator, the first program wheel, the second program wheel. FIG. 14(*d*) is an enlarged partial plane view showing portions of the third indicator and the third program wheel;

FIG. 15(*a*) is an enlarged partial plane view showing portions of the first date indicator and the first program wheel. FIG. 15(*b*) is an enlarged partial plane view showing portions of the second date indicator and the second program wheel. FIG. 15(*c*) is an enlarged partial plane view showing portions of the first date indicator, the second date indicator, the first program wheel, the second program wheel. FIG. 15(*d*) is an enlarged partial plane view showing portions of the third indicator and the third program wheel;

FIG. 16(*a*) is an enlarged partial plane view showing portions of the first date indicator and the first program wheel. FIG. 16(*b*) is an enlarged partial plane view showing portions of the second date indicator and the second program wheel. FIG. 16(*c*) is an enlarged partial plane view showing portions of the first date indicator, the second date indicator, the first program wheel, the second program wheel. FIG. 16(*d*) is an enlarged partial plane view showing portions of the third indicator and the third program wheel;

FIG. 17(*a*) is an enlarged partial plane view showing portions of the first date indicator and the first program wheel. FIG. 17(*b*) is an enlarged partial plane view showing portions of the second date indicator and the second program wheel. FIG. 17(*c*) is an enlarged partial plane view showing portions of the first date indicator, the second date indicator, the first program wheel, the second program wheel. FIG. 17(*d*) is an enlarged partial plane view showing portions of the third indicator and the third program wheel;

FIG. 18(*a*) is an enlarged partial plane view showing portions of the first date indicator and the first program wheel. FIG. 18(*b*) is an enlarged partial plane view showing portions of the second date indicator and the second program wheel. FIG. 18(*c*) is an enlarged partial plane view showing portions of the first date indicator, the second date indicator, the first program wheel, the second program wheel. FIG. 18(*d*) is an enlarged partial plane view showing portions of the third indicator and the third program wheel;

FIG. 19(*a*) is an enlarged partial plane view showing portions of the first date indicator and the first program wheel. FIG. 19(*b*) is an enlarged partial plane view showing portions of the second date indicator and the second program wheel. FIG. 19(*c*) is an enlarged partial plane view showing portions of the first date indicator, the second date indicator, the first program wheel, the second program wheel. FIG. 19(*d*) is an enlarged partial plane view showing portions of the third indicator and the third program wheel;

FIG. 20(*a*) is an enlarged partial plane view showing portions of the first date indicator and the first program wheel. FIG. 20(*b*) is an enlarged partial plane view showing portions of the second date indicator and the second program wheel. FIG. 20(*c*) is an enlarged partial plane view showing portions of the first date indicator, the second date indicator, the first program wheel, the second program wheel. FIG. 20(*d*) is an enlarged partial plane view showing portions of the third indicator and the third program wheel;

FIG. 21(*a*) is an enlarged partial plane view showing portions of the first date indicator and the first program wheel. FIG. 21(*b*) is an enlarged partial plane view showing portions of the second date indicator and the second program wheel. FIG. 21(*c*) is an enlarged partial plane view showing portions of the first date indicator, the second date indicator, the first program wheel, the second program wheel. FIG. 21(*d*) is an enlarged partial plane view showing portions of the third indicator and the third program wheel;

FIG. 22(*a*) is an enlarged partial plane view showing portions of the first date indicator and the first program wheel. FIG. 22(*b*) is an enlarged partial plane view showing portions of the second date indicator and the second program wheel. FIG. 22(*c*) is an enlarged partial plane view showing portions of the first date indicator, the second date indicator, the first program wheel, the second program wheel. FIG. 22(*d*) is an enlarged partial plane view showing portions of the third indicator and the third program wheel;

FIG. 28(*a*) is an enlarged partial plane view showing portions of the first date indicator and the first program wheel. FIG. 28(*b*) is an enlarged partial plane view showing portions of the second date indicator and the second program wheel. FIG. 28(*c*) is an enlarged partial plane view showing portions of the first date indicator, the second date indicator, the first program wheel, the second program wheel. FIG. 28(*d*) is an enlarged partial plane view showing portions of a third indicator and a third program wheel.

DETAILED DESCRIPTION OF THE PREFERRED EMBODIMENTS

An embodiment of a timepiece with a calendar mechanism according to the invention will be explained in reference to the drawings as follows.

(1) Structure of First Embodiment of Timepiece with Calendar Mechanism According to the Invention First, a first embodiment of a timepiece with calendar mechanism according to the invention will be explained. The first embodiment of the timepiece with calendar mechanism according to the invention is an embodiment constituting the timepiece with calendar mechanism by a mechanical type timepiece with automatic winding mechanism.

Figure 5:
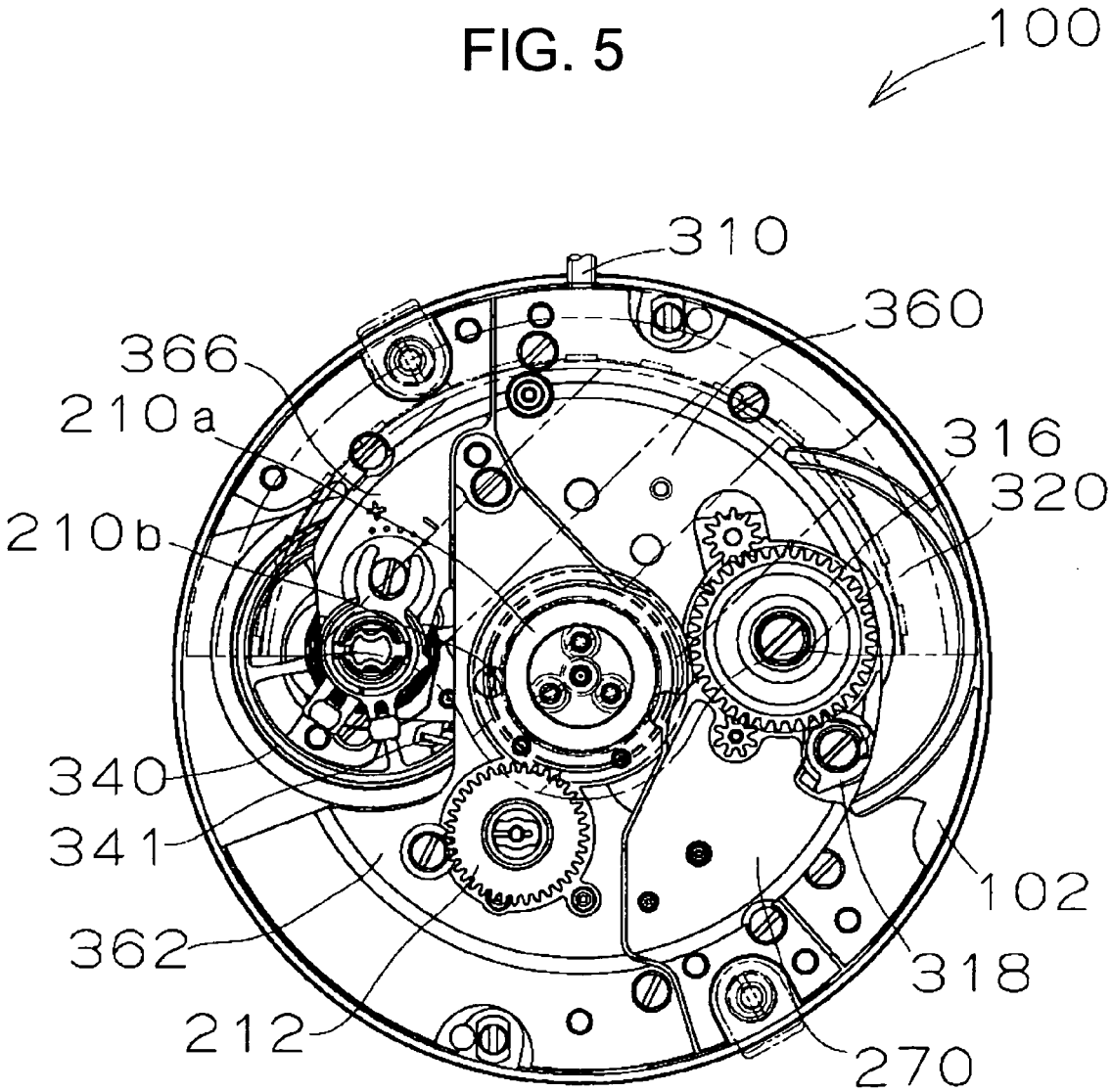
FIG. 5 is an outline plane view showing a structure when a movement is viewed from a case back side according to the first embodiment of the timepiece with calendar mechanism of the invention.
Figure 6:
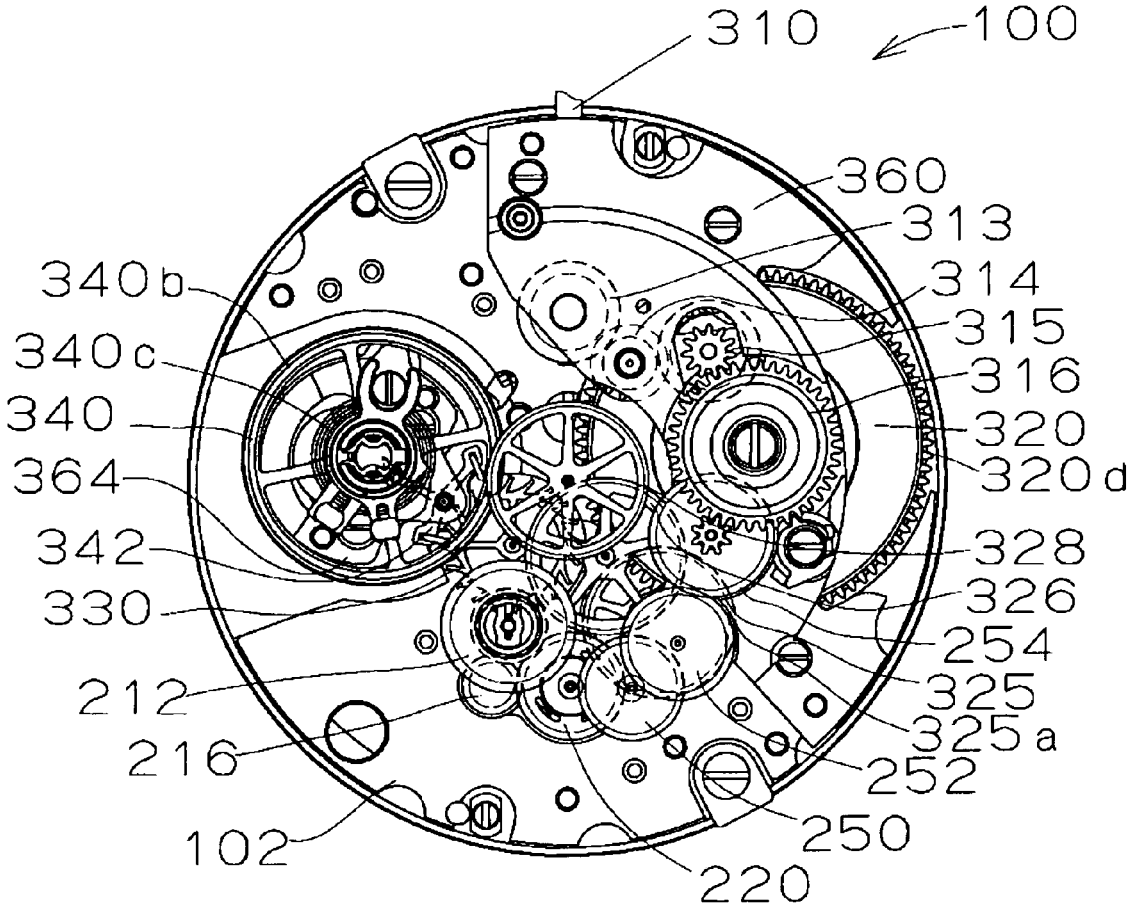
FIG. 6 is an outline plane view showing a structure when the movement in a state of removing a balance bridge, a train wheel bridge, an automatic winding train wheel bridge is viewed from the case back side according to the first embodiment of the timepiece with calendar mechanism of the invention.

(1.1) Structure of Top Side of Movement:

An outline structure of a top side (side of main plate opposed to dial) of a movement will be explained. In reference to FIG. 3 through FIG. 6, in a timepiece with calendar mechanism according to the invention, a movement 100 includes a main plate 102 constituting a base plate of the movement 100. A hand setting stem 310 is rotatably integrated to a hand setting stem guide hole of the main plate 102. A dial 104 (shown in FIG. 3, FIG. 4 by imaginary line) is attached to the movement 100. In reference to FIG. 5 and FIG. 6, an escapement/speed control apparatus including a balance with hairspring 340, and an escape wheel & pinion 330, a pallet fork 342, a fourth wheel & pinion 328, a third wheel & pinion 326, a second wheel & pinion 325, and a barrel complete 320 are arranged on "top side" of the movement 100. A switching apparatus including a setting lever, a yoke, a yoke spring, a yoke holder are arranged on "bottom side" of the movement 100. Further, a barrel bridge 360 for rotatably supporting an upper shaft portion of the barrel complete 320, an upper shaft portion of the second wheel & pinion 325, a train wheel bridge 362 for rotatably supporting an upper shaft portion of the third wheel & pinion 326, and upper shaft portion of the fourth wheel & pinion 328, an upper shaft portion of the escape wheel & pinion 330, and a pallet bridge 364 for rotatably supporting an upper shaft portion of the pallet fork 342, and a balance bridge 366 for rotatably supporting an upper shaft portion of the balance with hairspring 340 are arranged on "top side" of the movement 100.

(1.2) Automatic Winding Mechanism:

Next, a structure of an automatic winding mechanism will be explained. In reference to FIG. 3 through FIG. 6, an automatic winding mechanism includes an oscillating weight 210, a first transmission wheel & pinion 212 rotated based on rotation of the oscillating weight 210, a second transmission wheel & pinion 216 rotated based on rotation of the first transmission wheel & pinion 212, a switch transmission wheel & pinion 220 rotated in one direction based on rotation of the first transmission wheel & pinion 212 and the second transmission wheel & pinion 216, a first reduction wheel & pinion 250 rotated based on rotation of the switch transmission wheel 220, a second reduction wheel & pinion 252 rotated based on rotation of the first reduction wheel & pinion 250, and a third reduction wheel & pinion 254 rotated based on rotation of the second reduction wheel & pinion 252. The oscillating weight 210 includes an inner ring 210*a* fixed to the train wheel bridge 362, a plurality of balls 210*b*, an outer ring 210*c*, an oscillating weight pinion 212*d* integrally provided with the outer ring 210*c*, an oscillating weight member 210*e* fixed to the outer ring 210*c*, and an oscillating weight portion 210*f* fixed to the oscillating weight member 210*e*. The outer ring 210*c* is constituted to be rotatable relative to the inner ring 210*a* by way of the ball 210*b*. The first transmission wheel & pinion 212 includes a first transmission wheel and a first transmission pinion. The first transmission wheel & pinion 212 is provided rotatably to a first transmission wheel pin provided at the main plate 102. The oscillating weight pinion 210*d* is constituted to be brought in mesh with the first transmission wheel. The second transmission wheel & pinion 216 includes a second transmission wheel. The second transmission wheel is constituted to be brought in mesh with a first transmission pinion. An upper shaft portion of the second transmission wheel & pinion 216 and an upper shaft portion of the switch transmission wheel & pinion 220 are rotatably provided to the train wheel bridge 362. A lower shaft portion of the second transmission wheel & pinion 216, a lower shaft portion of the switch transmission wheel & pinion 220 are rotatably provided at the main plate 102.

The first reduction wheel & pinion 250 includes a first reduction wheel and a first reduction pinion. The second reduction wheel & pinion 252 includes a second reduction wheel. The first reduction pinion is constituted to be brought in mesh with the second reduction wheel. The third reduction wheel & pinion 254 includes a third reduction wheel and a third reduction pinion. The second reduction wheel is constituted to be brought in mesh with the first reduction pinion and the third reduction wheel. An upper shaft portion of the first reduction wheel & pinion 250, an upper shaft portion of the second reduction wheel & pinion 252 are rotatably provided at an automatic train wheel bridge (reduction bridge) 270. A lower shaft portion of the first reduction wheel & pinion 250, a lower shaft portion of the second reduction wheel & pinion 252 are rotatably provided at the barrel bridge 360. The third reduction wheel & pinion 254 is rotatably provided to a third reduction wheel & pinion pin provided at the barrel bridge 360. The third reduction pinion is constituted to be brought in mesh with a ratchet wheel 316. The switch transmission wheel 220 includes a switch transmission pinion. According to the automatic winding mechanism, regardless of a direction of rotating the oscillating weight 210, a rotational direction of the switch transmission pinion is constant and therefore, based on rotation of the switch transmission pinion, the ratchet wheel 316 can be rotated only in one direction by way of rotation of the first reduction wheel & pinion 250, the second reduction wheel & pinion 252, the third reduction wheel & pinion 254. By rotating the ratchet wheel 316, a main spring at inside of the barrel complete 320 can be wound up only in one direction.

(1.3) Escapement/Speed Control Apparatus and Top Train Wheel:

Next, a structure of the escapement/speed control apparatus and the top train wheel will be explained. A position in an axis line direction of the hand setting stem 310 is determined by a switching apparatus, mentioned later. When the hand setting stem 310 is rotated in a state in which the hand setting stem 310 is disposed at a first hand setting stem position (0 stage) on a side the most proximate to an inner side of the movement 100 along a rotation axis line direction, a winding pinion is rotated by way of rotation of a clutch wheel 311 (refer to FIG. 2). A crown wheel 313 is constituted to rotate by rotation of the winding pinion 312. A crown transmission wheel 314 is constituted to be rotated by rotation of the crown wheel 313. A pivoting crown wheel 315 is constituted to be rotated by rotation of the crown transmission wheel 314. The ratchet wheel 316 is rotated by rotation of the pivoting crown wheel 315. The barrel complete 320 includes a barrel wheel 320*d*, a barrel stem, and the main spring. The main spring contained in the barrel complete 320 is constituted to be wound up by rotating the ratchet wheel 316.

The second wheel & pinion 325 is constituted to be rotated by rotation of the barrel complete 320. The second wheel & pinion 325 includes a second wheel 325*a* and a second pinion. The barrel wheel 320*d* is constituted to be brought in mesh with the second pinion. The third wheel & pinion 326 is constituted to be rotated by rotation of the second wheel & pinion 325. The third wheel & pinion 326 includes a third wheel and a third pinion. The fourth wheel & pinion 328 is constituted to rotate by one rotation per 1 minute by rotation of the third wheel & pinion 326. The fourth wheel & pinion 328 includes a fourth wheel and a fourth pinion. The third wheel is constituted to be brought in mesh with the fourth pinion. The escape wheel & pinion 330 is constituted to be rotated by rotation of the fourth wheel & pinion 328 while being controlled by the pallet fork 342. The escape wheel & pinion 330 includes an escape wheel and an escape pinion. The fourth wheel is constituted to be brought in mesh with the escape pinion. The barrel complete 320, the second wheel & pinion 325, the third wheel & pinion 326, the fourth wheel & pinion 328 constitute the top train wheel. The escapement/speed control apparatus for controlling rotation of the top train wheel includes the balance with hairspring 340, the escape wheel & pinion 330, the pallet fork 342. That is, the escape wheel & pinion 330, the pallet fork 342, the balance with hairspring 340 constitute the escapement/speed control apparatus. The balance with hairspring 340 includes a balance stem, a balance wheel 340*b*, and a hairspring 340*c*. The hairspring 340*c* is a thin plate spring of a mode in a spiral shape (helical shape) having a plurality of turn numbers. The balance with hairspring 340 is rotatably supported by the main plate 102 and the balance bridge 366.

The barrel complete 320, the second wheel & pinion 325 are rotatably supported by the main plate 102 and the barrel bridge 360. That is, an upper shaft portion of the barrel complete 320 is rotatably supported by the barrel bridge 360, an upper shaft portion of the second wheel & pinion 325, an upper shaft portion of the escape wheel & pinion 330 are rotatably supported by the train wheel bridge 362. Further, a lower shaft portion of the barrel complete 320, a lower shaft portion of the second wheel & pinion 325 are rotatably supported by the main plate 102. The third wheel & pinion 326, the fourth wheel & pinion 328, the escape wheel & pinion 330 are rotatably supported by the main plate 102 and the train wheel bridge 362. That is, an upper shaft portion of the third wheel & pinion 326, an upper shaft portion of the fourth wheel & pinion 328, an upper shaft portion of the escape wheel & pinion 330 are rotatably supported by the train wheel bridge 362. A lower shaft portion of the third wheel & pinion 326, a lower shaft portion of the escape wheel & pinion 330 are rotatably supported by the main plate 102. A lower shaft portion of the fourth wheel & pinion 328 is rotatably supported at inside of a center hole of a center pipe 102*j* fixed to the main plate 102. The pallet fork 342 is rotatably supported by the main plate 102 and the pallet bridge 364. An upper shaft portion of the pallet fork 342 is rotatably supported by the pallet bridge 364. A lower shaft portion of the pallet fork 342 is rotatably supported by the main plate 102. By rotation of the second wheel & pinion 325, the fourth wheel & pinion 328 is rotated by one rotation per 1 minute by way of rotation of the third wheel & pinion 326. A second hand 358 attached to the fourth wheel & pinion 328 indicates "second".

(1.4) Switching Mechanism, Bottom Train Wheel, Hand Setting Mechanism:

Constitutions of a switching mechanism, a hand setting mechanism will be explained as follows. In reference to FIG. 2 and FIG. 3, a switching apparatus including a setting lever 370, a yoke 371, and a yoke holder 372 are arranged on "bottom side" of the movement 100. The switching apparatus can also be arranged on "top side" of the movement 100. The clutch wheel 311 is arranged to include a rotational axis line the same as the rotational axis line of the hand setting stem 310. When the hand setting stem 310 is disposed at 0 stage, 1 stage, 2 stage, the clutch wheel 311 is constituted to rotate based on rotation of the hand setting stem 310. A setting wheel 376 is arranged rotatably relative to a setting wheel rotating lever 374.

Figure 2:
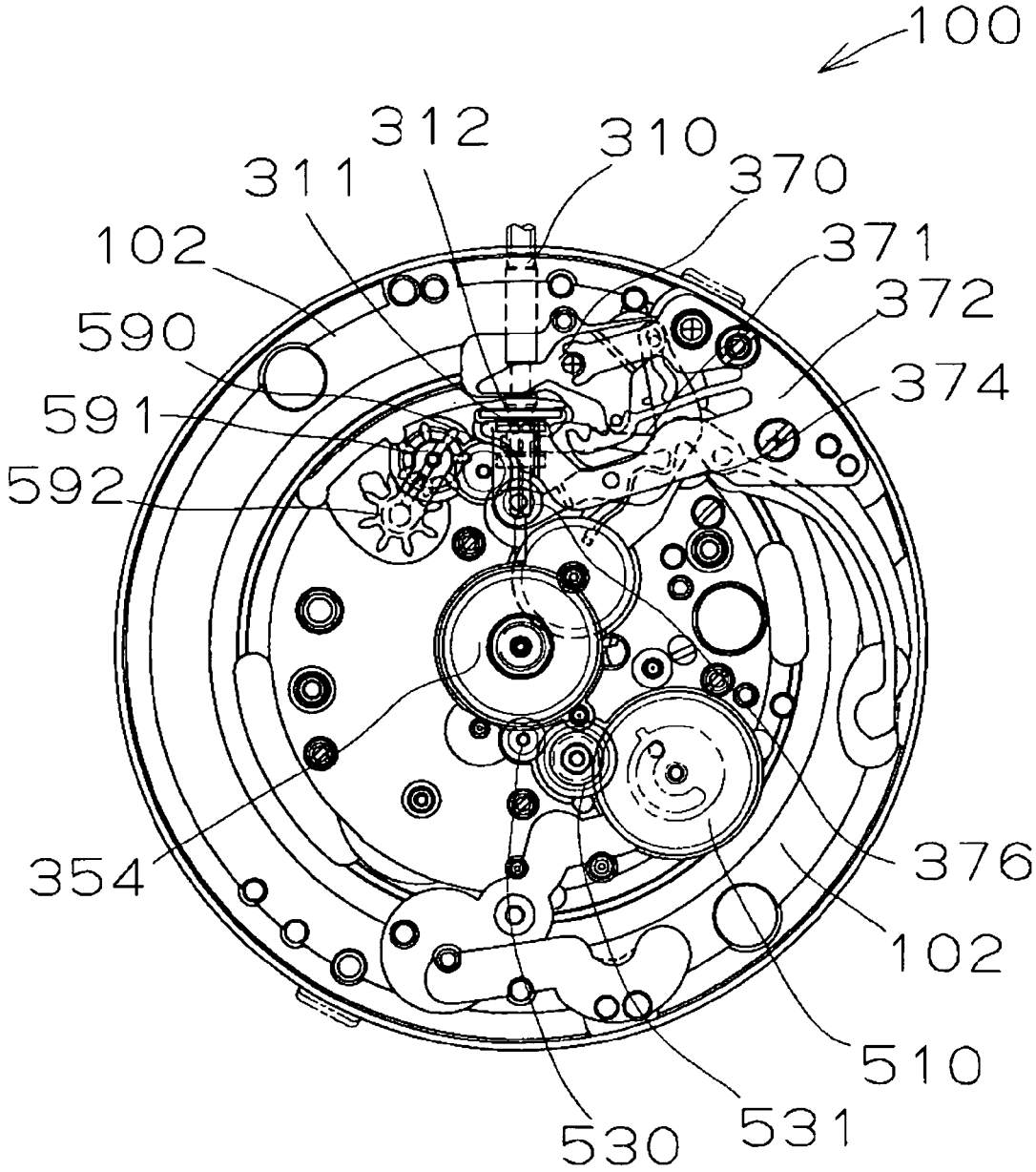
FIG. 2 is an outline plane view showing a structure when the movement in a state of removing a second main plate from the dial side according to the first embodiment of the timepiece calendar mechanism of the invention.
Figure 3:
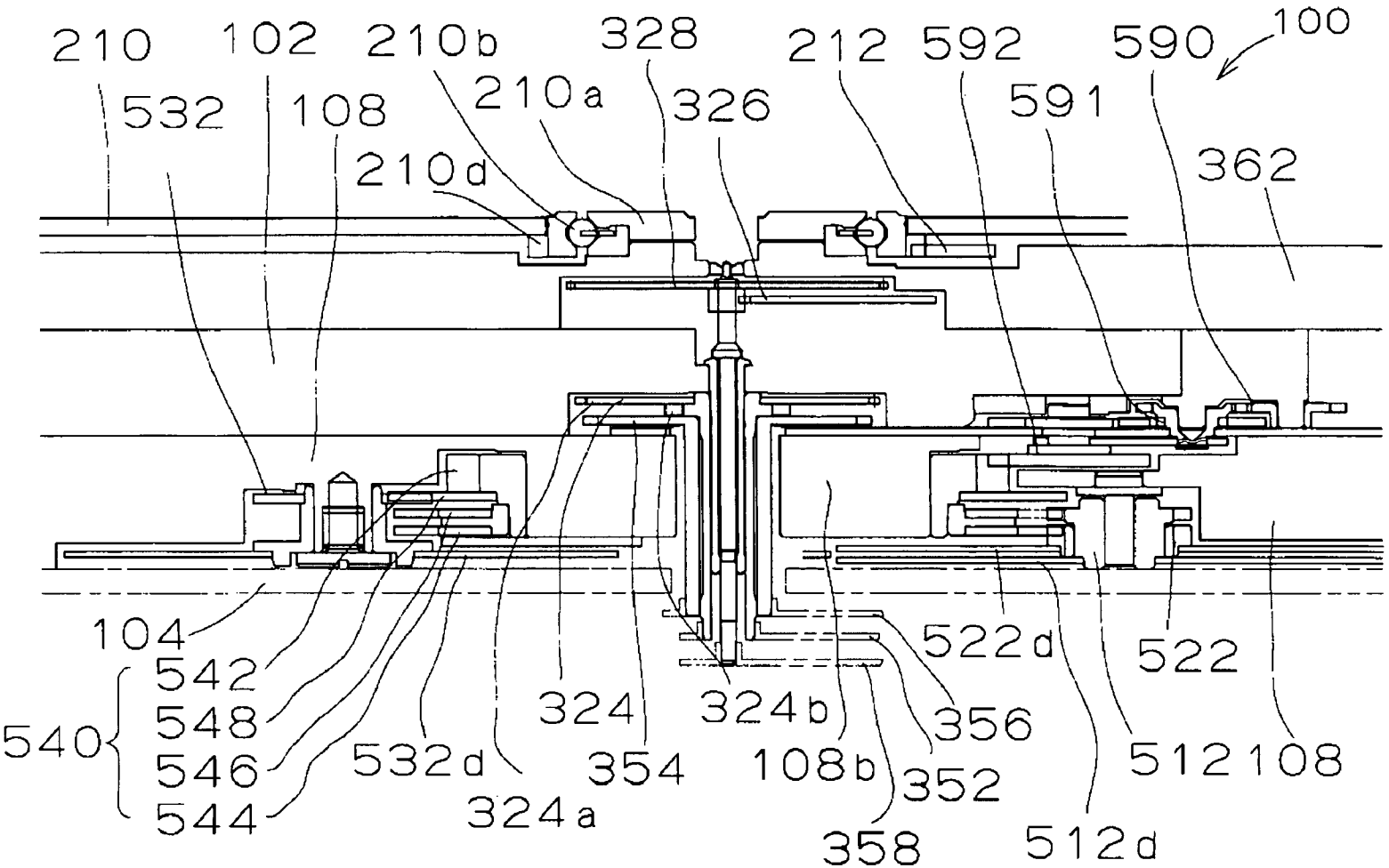
FIG. 3 is a partial sectional view showing portions of a first date indicator, a second date indicator, and a program wheel according to the first embodiment of the timepiece with calendar mechanism of the invention.
Figure 4:
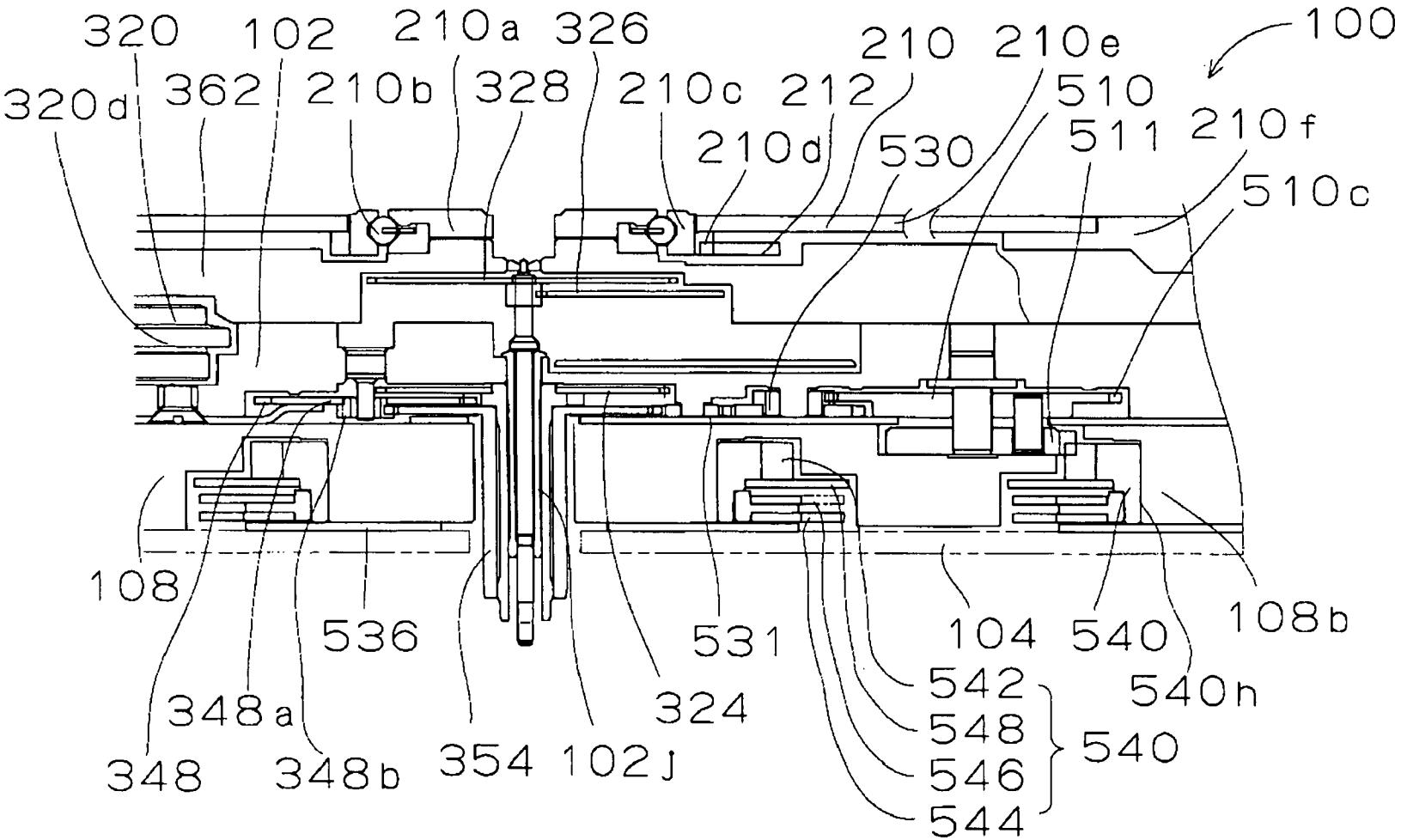
FIG. 4 is a partial sectional view showing portions of the program wheel, a date driving wheel according to the first embodiment of the timepiece with calendar mechanism of the invention.

In reference to FIG. 2 through FIG. 4, a second main plate 108 is arranged on a side of the dial 104 of the main plate 102. A minute wheel & pinion 324 includes a minute wheel 324*a* and a cannon pinion 324*b*. The minute wheel 324*a* is constituted to be brought in mesh with the third pinion. The minute wheel 342*a* and the cannon pinion 324*b* are constituted to rotate integrally. The minute wheel 324*a* is arranged between the main plate 102 and the second main plate 108. The cannon pinion 324*b* and the minute wheel 324*a* are provided with a slip mechanism constituted to enable the cannon pinion 324*b* relative to the minute wheel 324*a*. A minute wheel & pinion 348 is constituted to rotate by rotation of the third wheel & pinion 326 by way of rotation of the minute indicator 324. The minute wheel 348 includes a minute wheel 348*a*, a minute pinion 348*b*. The minute wheel & pinion 348 is arranged between the main plate 102 and the second main plate 108. The hour pinion 324*b* is constituted to be brought in mesh with the minute wheel 348*a*. An hour wheel 354 is constituted to be brought in mesh with the minute pinion 348*b*. A wheel portion of the hour wheel 354 is arranged between the main plate 102 and the second main plate 108.

The hour wheel 354 is constituted to be rotated by one rotation per 12 hours by way of rotation of the minute wheel & pinion 348. The minute indicator 324, the minute wheel & pinion 348, the hour wheel 354 constitute the bottom train wheel. The minute wheel 324 is rotated by one rotation per 1 hour by rotation of the barrel complete 320 by way of rotation of the second wheel & pinion 325, the third wheel & pinion 326. A minute hand 352 attached to the hour pinion 324*b* of the minute wheel & pinion 324 indicates "minute". Based on rotation of the minute wheel & pinion 324, the hour wheel & pinion 354 is rotated by one rotation per 12 hours by way of rotation of the minute wheel & pinion 348. An hour hand 356 attached to the hour wheel & pinion 354 indicates "hour". When the hand setting stem 310 is pulled to 2 stage, the setting wheel operating lever 374 is rotated, when the hand setting stem 310 is rotated in a state of being disposed at a third hand setting stem position (2 stage), the minute wheel & pinion 348 can be rotated by way of rotation of the clutch wheel 311, the setting wheel 376. In a state in which the hand setting stem 310 is disposed at 2 stage, when the minute wheel & pinion 348 is rotated, the cannon pinion 324*b* and the hour wheel 354 can be rotated and therefore, time of the timepiece can be corrected. Under the state, the cannon pinion 324*b* can be slipped relative to the minute wheel 324*a* by the slipping mechanism provided at the cannon pinion 324*b* and the minute wheel 324*a*.

(1.5) Constitution of Date Indicator Driving Mechanism:

A constitution of a date indicator driving mechanism will be explained as follows. In reference to FIG. 1 through FIG. 4, a date indicator driving mechanism includes an intermediate first date driving wheel & pinion 530, an intermediate second date driving wheel & pinion 531, a date driving wheel & pinion 510, a date driving finger 511, a program wheel & pinion 540, a program date wheel jumper 534. The intermediate first date driving intermediate wheel & pinion 530 is rotatably integrated to an intermediate first date driving wheel pin provided at the main plate 102. The intermediate second date driving wheel & pinion 531 is rotatably integrated to an intermediate second date driving wheel pin provided at the main plate 102. The date driving wheel 510 and the date driving finger 511 are rotatably integrated to a pin provided at the main plate 102. A wheel portion of the hour wheel & pinion 354 is brought in mesh with a wheel portion of the intermediate wheel first date driving wheel & pinion 530. The wheel portion of the intermediate first date driving wheel & pinion 530 is brought in mesh with a wheel portion of the intermediate second date driving wheel & pinion 531. A pinion portion of the intermediate second date driving wheel & pinion 531 is brought in mesh with a wheel portion of a date driving wheel 510*c*. By rotating the hour wheel & pinion 354, the date driving wheel & pinion 510 is constituted to rotate by one rotation per 24 hours by way of rotation of the intermediate first date driving wheel & pinion 530, the intermediate second date driving wheel & pinion 531. A date driving finger 511 is constituted to rotate based on rotation of the date driving wheel 510. The intermediate first date driving wheel & pinion 530 and the intermediate second date driving wheel & pinion 531 are arranged between the main plate 102 and the second main plate 108. The date driving wheel & pinion 510 is arranged between the main plate 102 and the second main plate 108. It is preferable to arrange a rotational center of the date driving wheel 510 between "7 o'clock direction" and "8 o'clock direction" of the dial.

In reference to FIG. 1 through FIG. 4 and FIG. 9, a center hole 540*h* of the program wheel & pinion 540 is rotatably integrated to an outer periphery of a program wheel guide shaft portion 108*b* provided at the second main plate 108. A program wheel holder 536 is arranged on a side of the dial 104 of the second main plate 108. The program wheel & pinion 540 is arranged between the second main plate 108 and the program wheel holder 536. In a state in which the hour wheel & pinion 354, the minute indicator 324 constituting time indicating wheels are rotatable, rotation center axis lines of the hour wheel 354, the minute indicator 324 constituting the time indicating wheels are constituted to be disposed on an inner side of a center hole 540*h* of the program wheel & pinion 540. It is preferable to constitute the rotation center axis lines of the hour wheel & pinion 354, the minute indicator 324 constituting the time indicating wheels to coincide with a rotation center axis line of the program wheel & pinion 540. By the constitution, in the timepiece with calendar mechanism, an area occupied by a driving mechanism for driving a first date indicator 512, a second date indicator 522, a third date indicator 532 can be reduced.

In reference to FIG. 1 through FIG. 4 and FIG. 9 through FIG. 11, the program wheel & pinion 540 includes a program date indicator 542 constituted to rotate by rotation of the date driving claw 511, a first program wheel 544 constituted to be able to rotate integrally with the program date indicator 542 and to be able to rotate the first date indicator 512 intermittently, a second program wheel 546 constituted to be able to rotate integrally with the program date wheel 542 and to be able to rotate the second date indicator 522 intermittently, and a third program wheel 548 constituted to be able to rotate integrally with the program date indicator 542 and to be able to rotate a third date indicator 532 intermittently. The program date wheel 542, the first program wheel 544, the second program wheel 546, the third program wheel 548 can be constituted by a laminated structure such that respective center axis lines thereof are disposed at the same position.

The program date indicator 542 is arranged on a side the most proximate to the main plate 102. The third program wheel 548 is arranged on a side proximate to the main plate 102 next to the program date wheel 542. The first program wheel 544 is arranged to a side the most proximate to the dial 104. The second program wheel 546 is arranged to a side proximate to the dial 104 next to the first program wheel 544. That is, the program date indicator 542, the third program wheel 548, the second program wheel 546, the first program wheel 544 are arranged by a laminated structure in this order from the side the most proximate to the main plate 102 to the dial 104. Or, an order of laminating the program date indicator 542, the third program wheel 548, the second program wheel 546, the first program wheel 544 may be constituted to constitute the above-described order.

Figure 1:
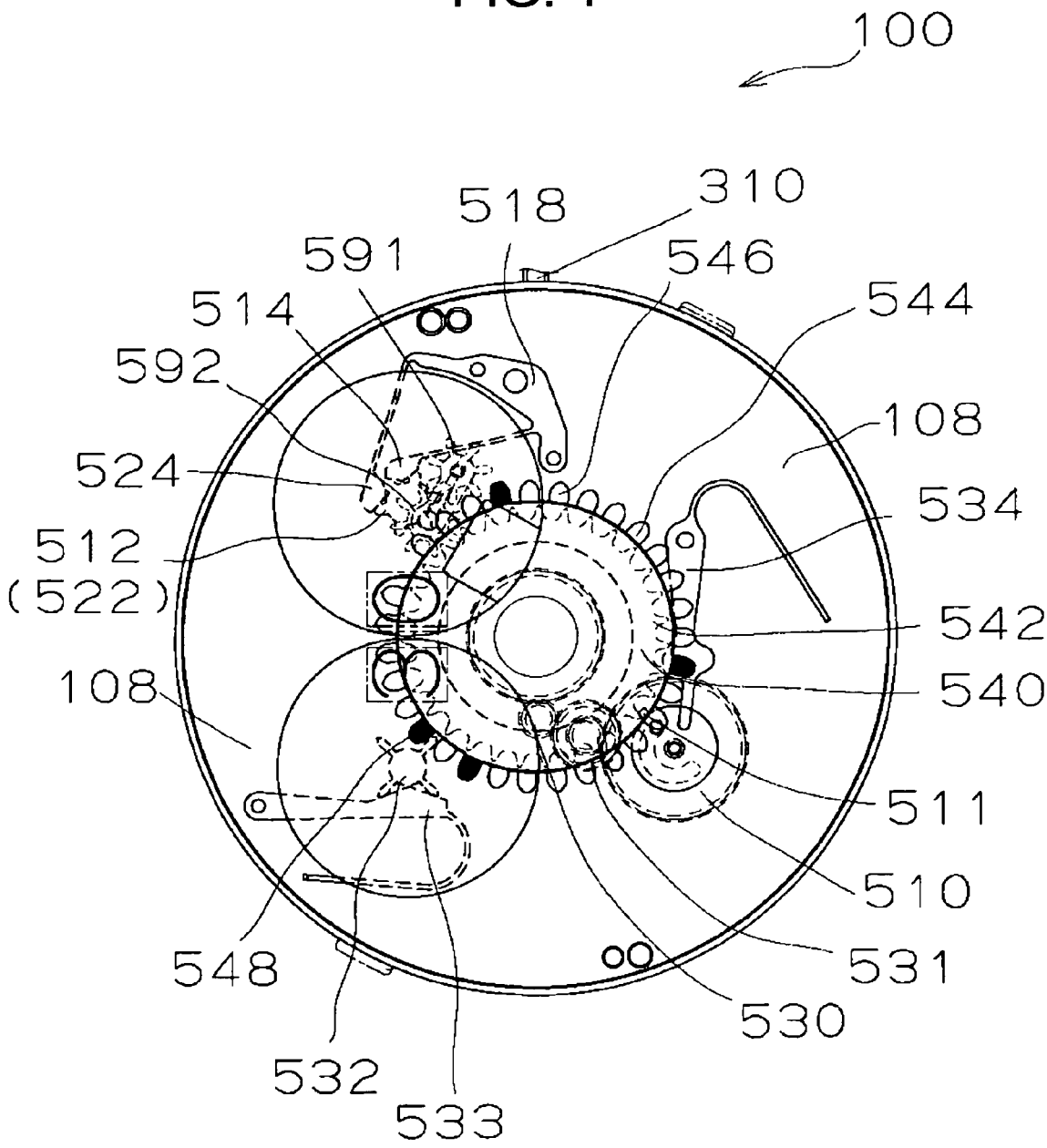
FIG. 1 is an outline plane view showing a relationship of arrangements of three date indicators and a program wheel when a movement is viewed from a dial side according to a first embodiment of a timepiece with calendar mechanism of the invention.

In the program wheel & pinion 540 illustrated in FIG. 1, portions in a trapezoidal shape coated in black indicate portions at which teeth portions are present at both of the second program wheel 546 and the third program wheel 548 and portions in the trapezoidal shape which are not coated in black indicate portions at which teeth portions are present at the first program wheel 544 and/or the second program wheel 546.

In reference to FIG. 1 and FIG. 3, the first date indicator 512 is rotatably integrated to the second main plate 108. The first date indicator jumper 514 is integrated to the second main plate 108. The first date indicator jumper 514 for rectifying a position in a rotational direction of the first date indicator 512 includes a spring portion and a rectifying portion provided at a front end of the spring portion. The rectifying portion of the first date indicator jumper 514 is constituted to rectify two pieces of teeth portions 516 of the first date indicator 512.

The second date indicator 522 is rotatably integrated to the first date indicator 512. A second date indicator jumper 524 for rectifying a position in a rotational direction of the second date indicator 522 is integrated to the second main plate 108. The second date indicator jumper 524 includes a spring portion and a rectifying portion provided at a front end of the spring portion. The rectifying portion of the second indicator jumper 524 is constituted to rectify two pieces of teeth portions 526 of the second date indicator 522. The first date indicator jumper 514 and the second date indicator jumper 524 can be constituted as portions of a first and second date indicator jumper 518. Or, the first date indicator jumper 514 and the second date indicator jumper 524 may be constituted as separate parts.

The third date indicator 532 is rotatably integrated to the second main plate 108. A third date indicator jumper 533 for rectifying a position in a rotational direction of the third date indicator 532 is integrated to the second main plate 108. The third date indicator jumper 533 includes a spring portion and a rectifying portion provided at a front end of the spring portion. The rectifying portion of the third date indicator jumper 533 is constituted to rectify two pieces of teeth portions 535 of the third date indicator 532.

In reference to FIG. 1, it is preferable to arrange a rotational center of the first date indicator 512 and a rotational center of the second date indicator 522 between "1 o'clock direction" and "2 o'clock direction" of the dial. It is preferable to arrange the rotational center of the first date indicator 512 and the rotational center of the second date indicator 522 at the same position. It is preferable that a straight line connecting the rotational center of the first date indicator 512 and a rotational center of the third date indicator 532 becomes in parallel with a center axis line of the barrel complete 320. By this construction, a timepiece with calendar mechanism in which a calendar indication is large and easy to see can be realized.

It is preferable to position an outer peripheral portion of the first date indicator 512 and an outer peripheral portion of the second date indicator 522 to be proximate to an outer peripheral portion of the third date indicator 532. Outer peripheries of the first date indicator 512 and the third date indicator 532 are positioned to be proximate to each other, and information with regard to date is constituted to be able to be indicated by one of first date characters provided at the first date indicator 512 and one of third date characters provided at the third date indicator 532. Further, the outer peripheral portions of the second date indicator 522 and the third date indicator 532 are positioned to be proximate to each other, and information with regard to date can be indicated by one of the first date characters provided at the first date indicator 512 and the third date characters provided at the third date indicator 532.

Figure 9:
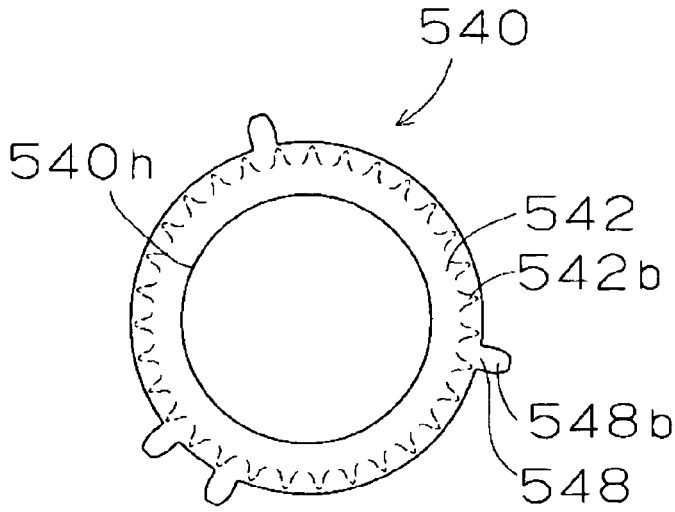
FIG. 9 is a plane view showing a third program wheel according to the first embodiment of the timepiece with calendar mechanism of the invention.

In reference to FIG. 9, the program date wheel 542 includes 31 pieces of program date indicator teeth portions 542*b* formed to constitute equal angular intervals. The angular interval of the program date indicator teeth portions 542*b* is 360/31 degrees. Rotational center axis lines of the hour wheel & pinion 354 and the minute indicator 324 constituting the time indicating wheels are constituted to coincide with the rotational center axis line of the program wheel & pinion 540. When constituted in this way, the program date indicator 542 is disposed at the center of the movement 100, an outer diameter dimension of the program date indicator 542 can be increased and therefore, a calendar correcting mechanism can be arranged freely to some degrees. According to the constitution, a module of a wheel constituting the calendar correcting mechanism can be increased. Therefore, according to the timepiece with calendar mechanism of the invention, a degree of freedom of design of the calendar correcting mechanism is large.

Figure 10:
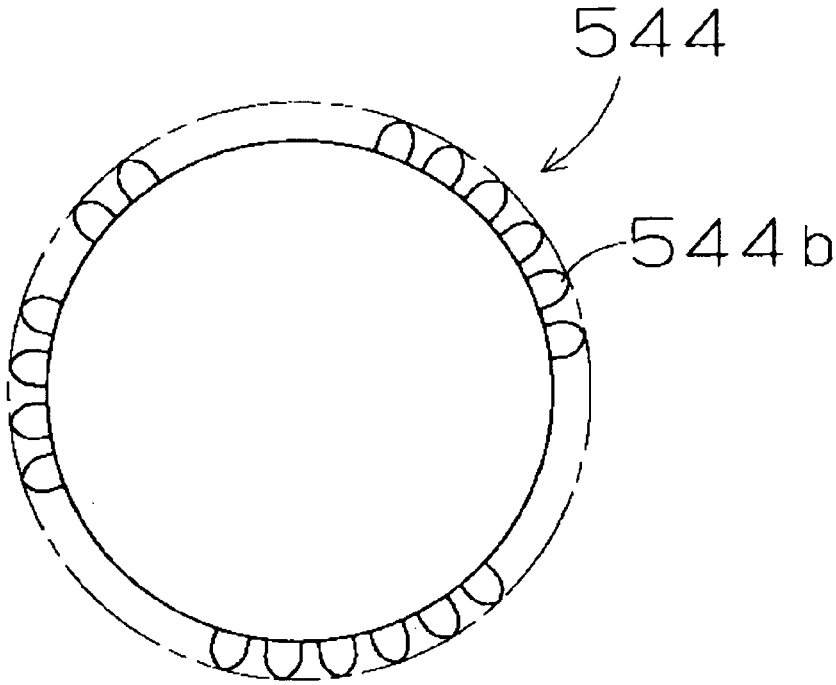
FIG. 10 is a plane view showing a first program wheel according to the first embodiment of the timepiece with calendar mechanism of the invention.

In reference to FIG. 10, the first program wheel 544 includes 18 pieces of first program wheel teeth portions 544*b* formed by the equal shape. Angular intervals of the first program wheel teeth portions 544*b* are 360/31 degrees, 360/31 degrees, 360/31 degrees, 360/31 degrees, 360/31 degrees, 5*360/31 degrees, 360/31 degrees, 360/31 degrees, 360/31 degrees, 360/31 degrees, 360/31 degrees, 5*360/31 degrees, 360/31 degrees, 360/31 degrees, 360/31 degrees, 2*360/31 degrees, 360/31 degrees, 5*360/31 degrees.

Figure 11:
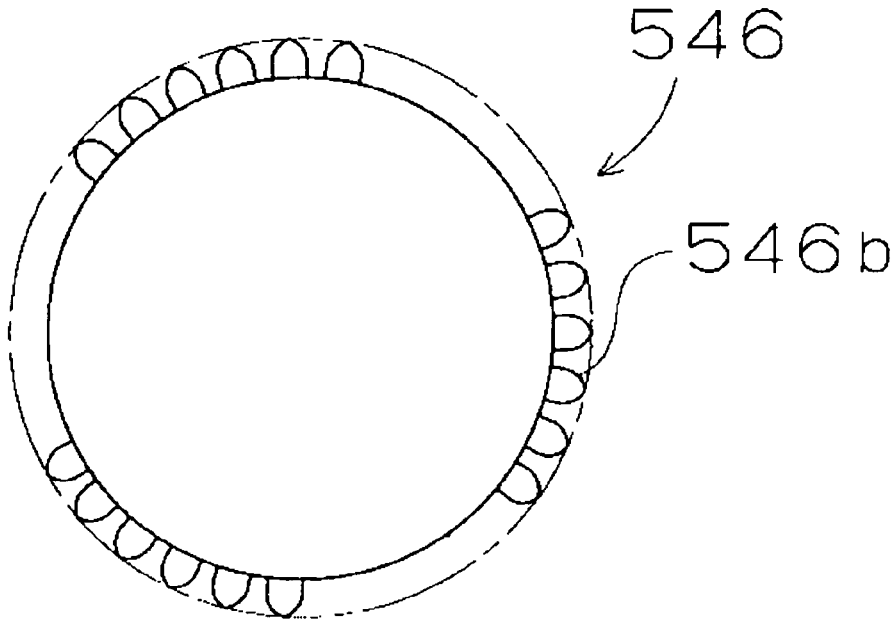
FIG. 11 is a plane view showing a second program wheel according to the first embodiment of the timepiece with calendar mechanism of the invention.
Figure 12:
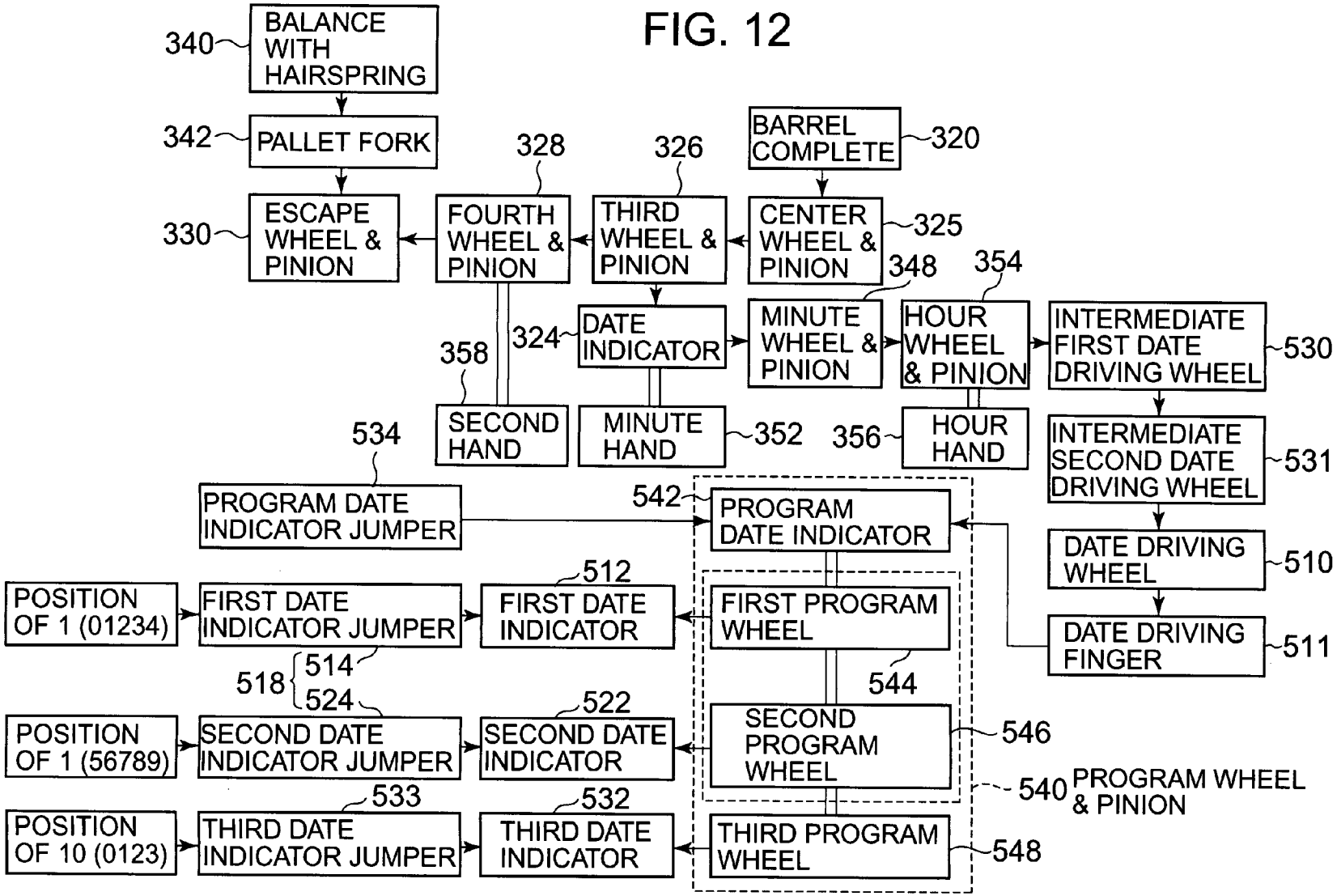
FIG. 12 is a block diagram showing a drive mechanism, a top train wheel, a calendar mechanism and the like according to the first embodiment of the timepiece with calendar mechanism of the invention.
Figure 13A:
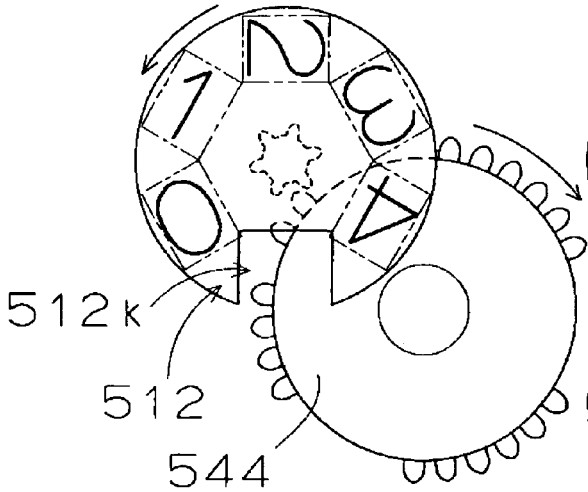
FIG. 13 illustrates partial plane views showing a state of indicating "29 day" according to the first embodiment of the timepiece with calendar mechanism of the invention.
Figure 13B:
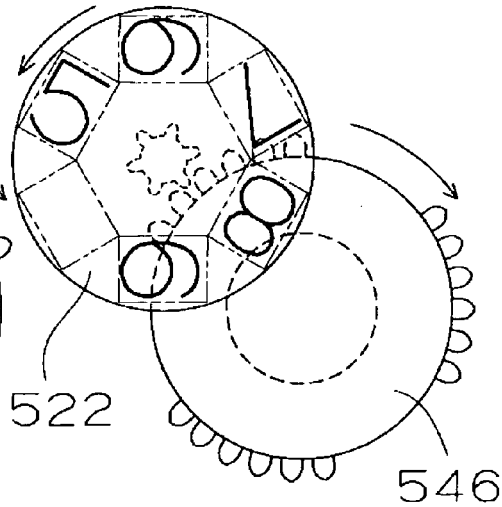
Figure 13C:
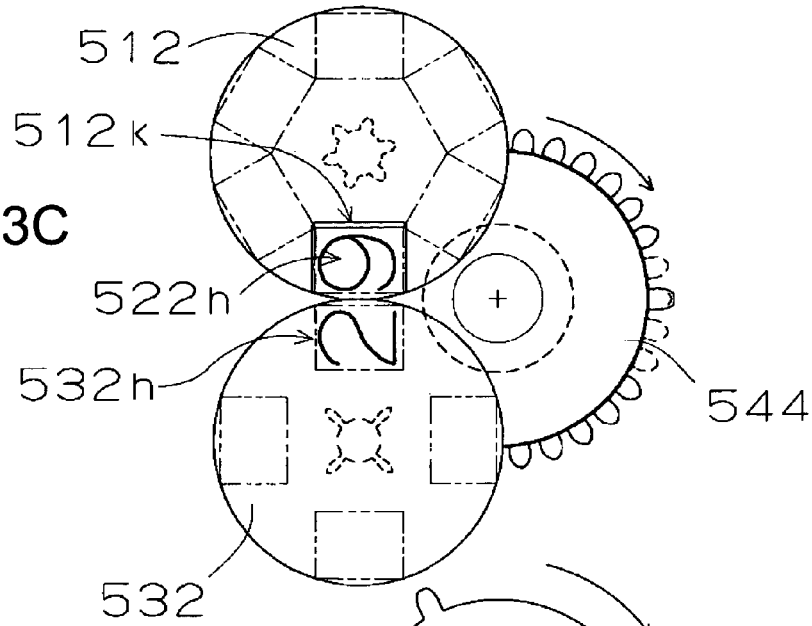
Figure 13D:
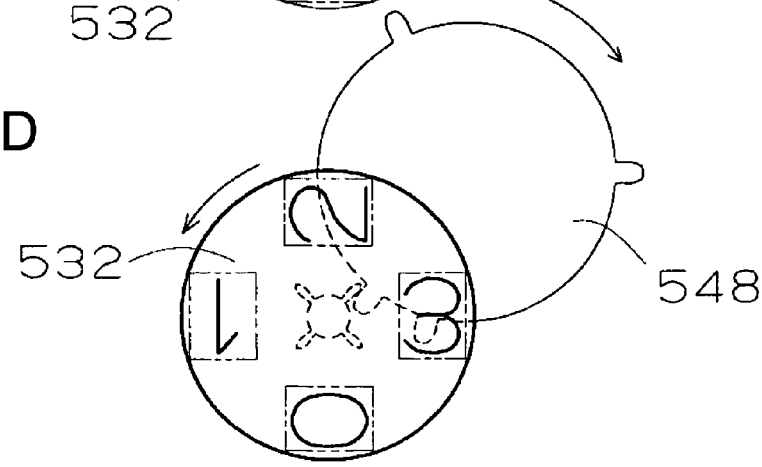
Figure 14A:
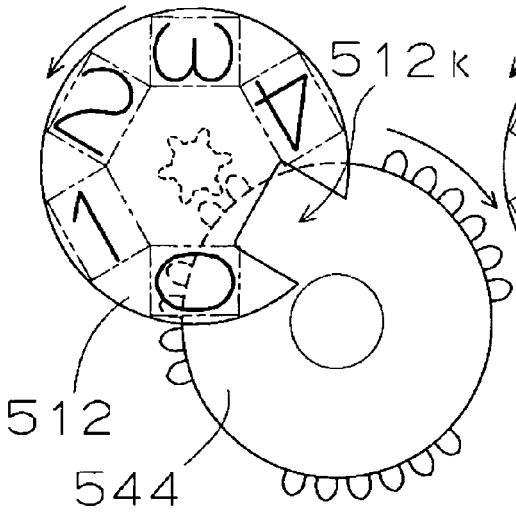
FIG. 14 illustrates partial plane views showing a state of indicating "30 day" according to the first embodiment of the timepiece with calendar mechanism of the invention.
Figure 14B:
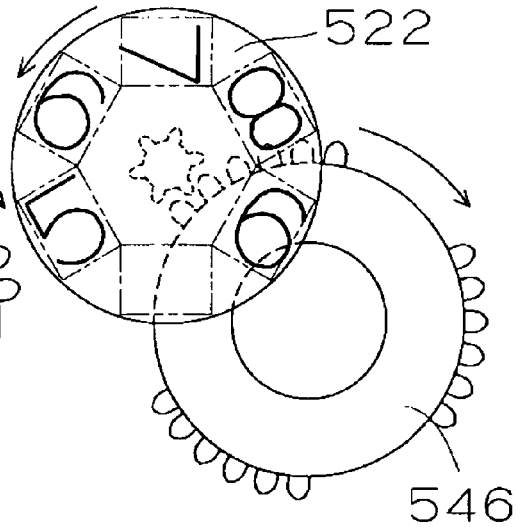
Figure 14C:
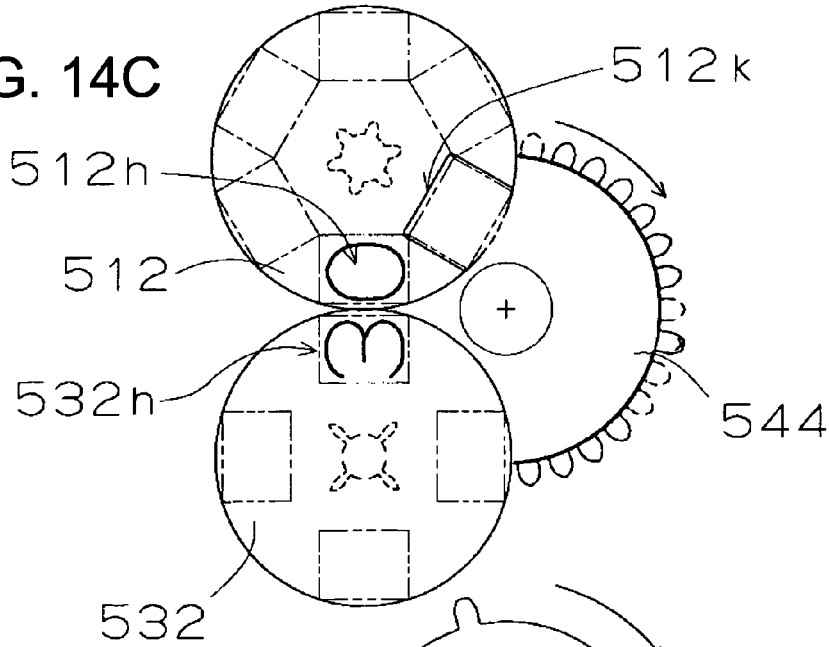
Figure 14D:
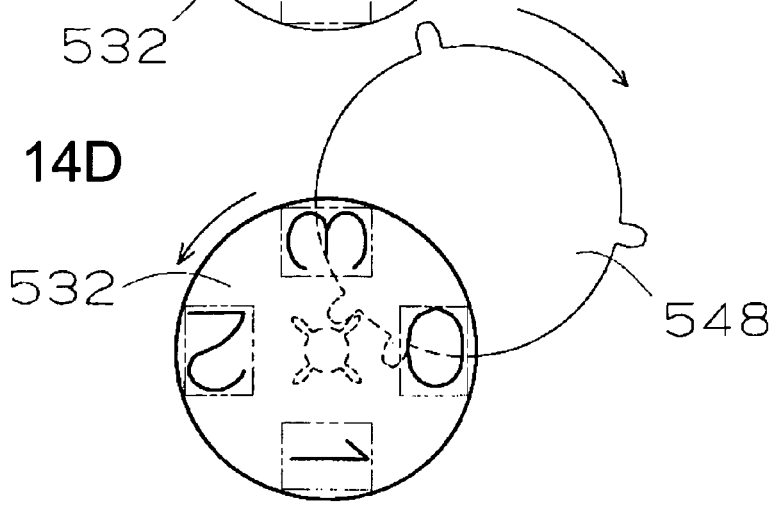
Figure 15A:
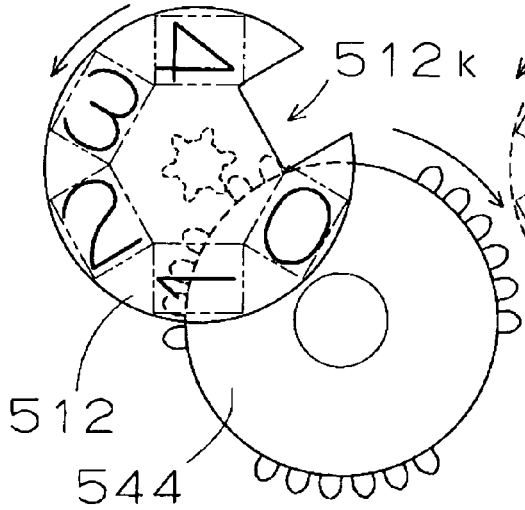
FIG. 15 illustrates partial plane views showing a state of indicating "31 day" according to the first embodiment of the timepiece with calendar mechanism of the invention.
Figure 15B:
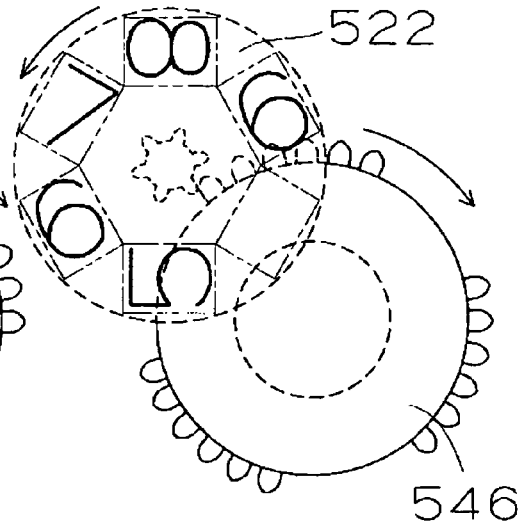
Figure 15C:
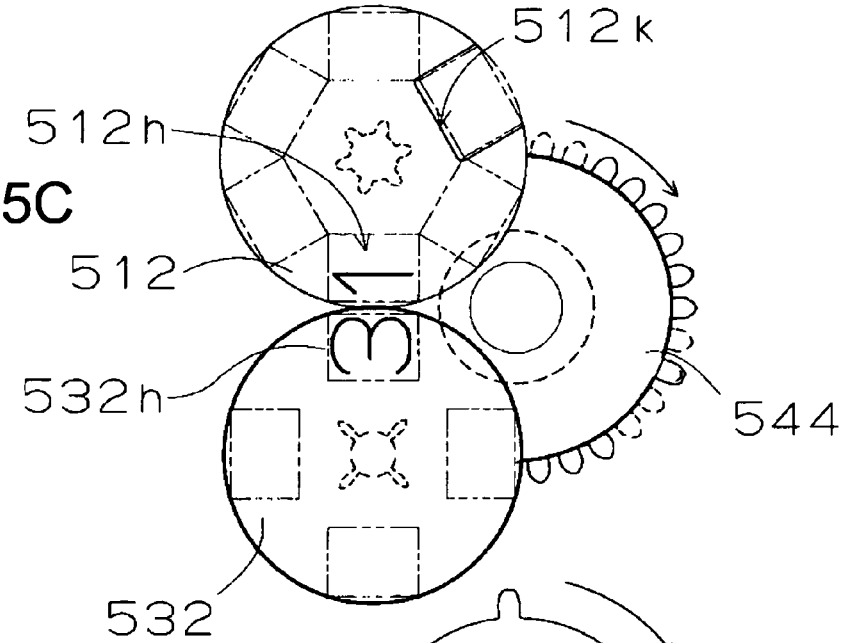
Figure 15D:
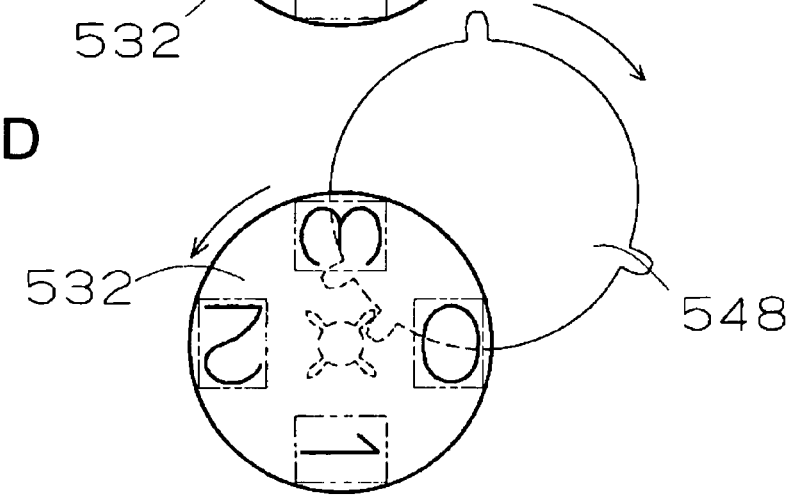
Figure 16A:
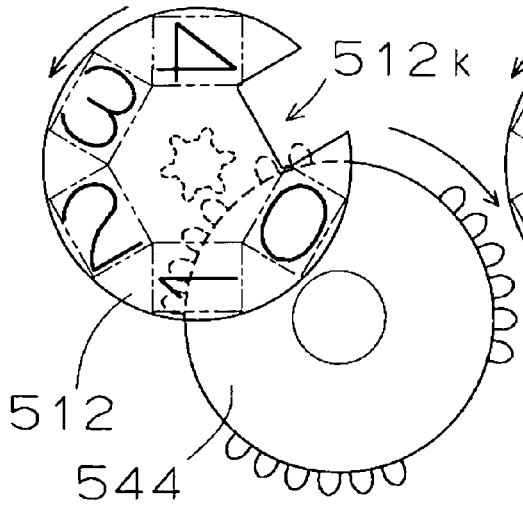
FIG. 16 illustrates partial plane views showing a state of indicating "1 day" according to the first embodiment of the timepiece with calendar mechanism of the invention.
Figure 16B:
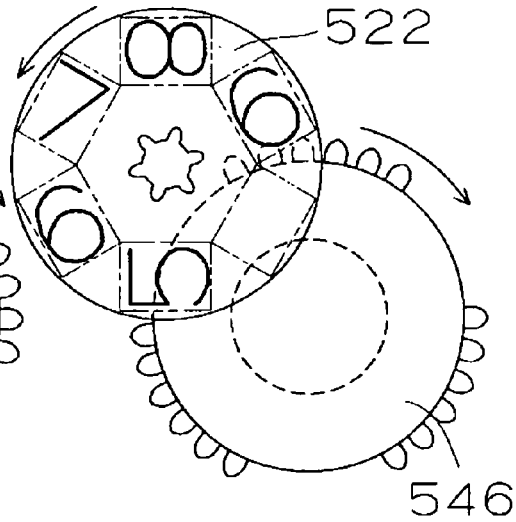
Figure 16C:
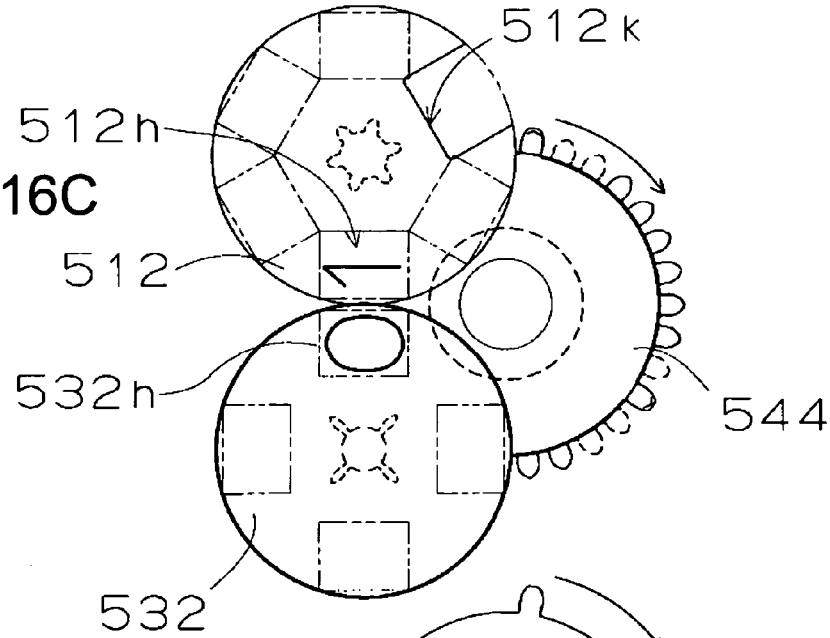
Figure 16D:
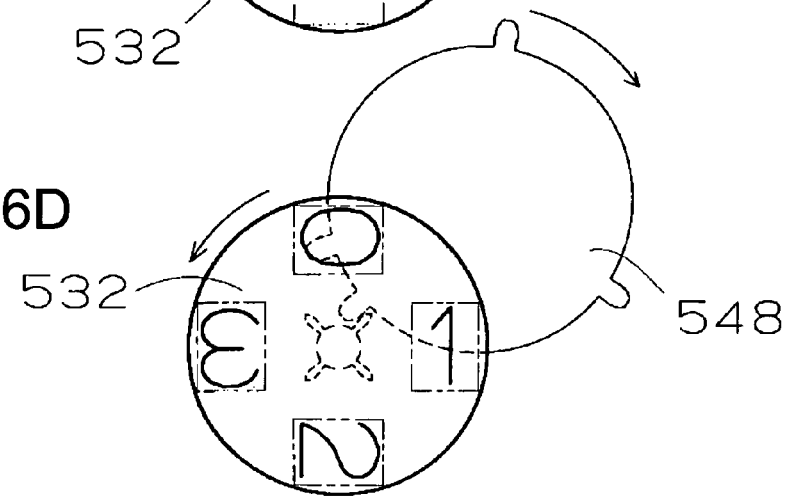
Figure 17A:
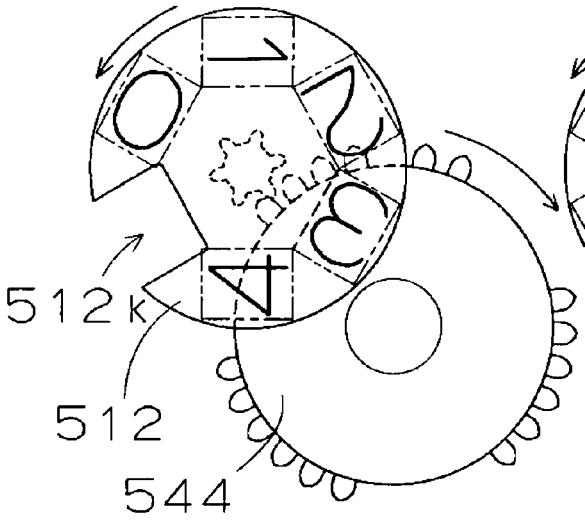
FIG. 17 illustrates partial plane views showing a state of indicating "4 day" according to the first embodiment of the timepiece with calendar mechanism of the invention.
Figure 17B:
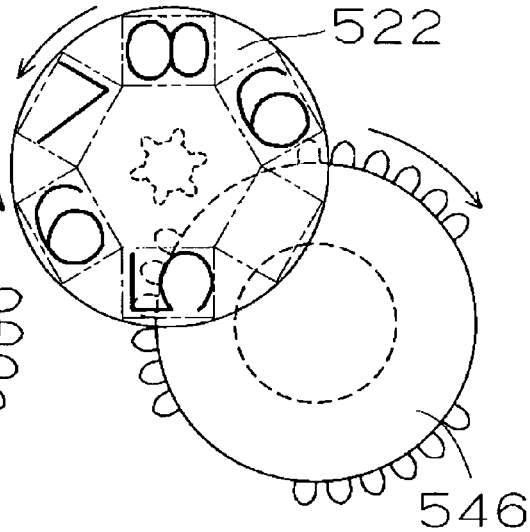
Figure 17C:
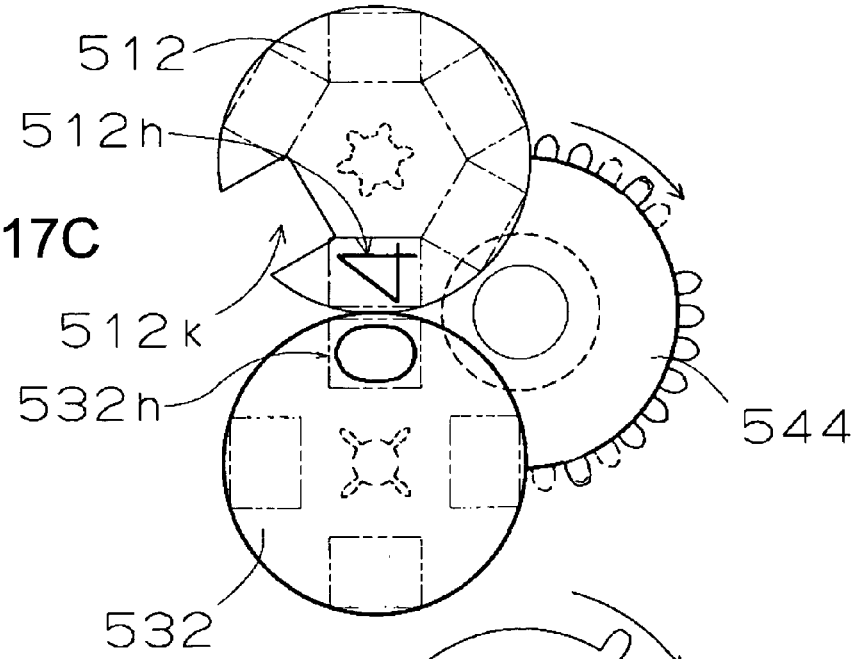
Figure 17D:
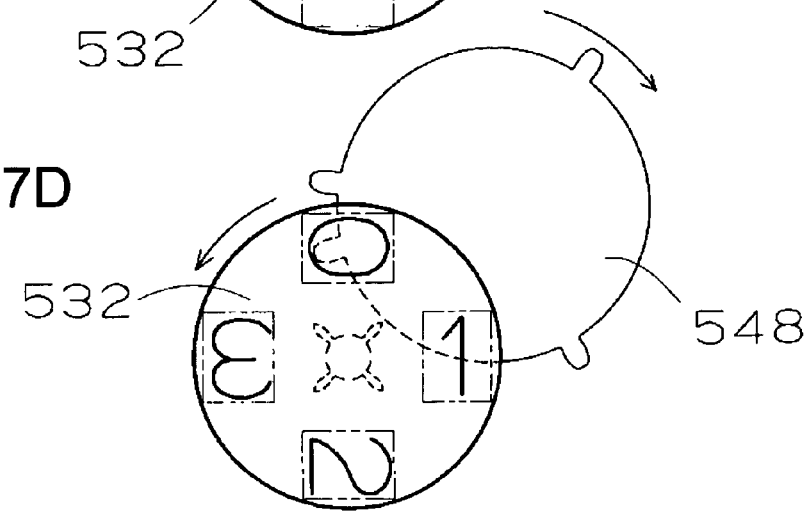
Figure 18A:
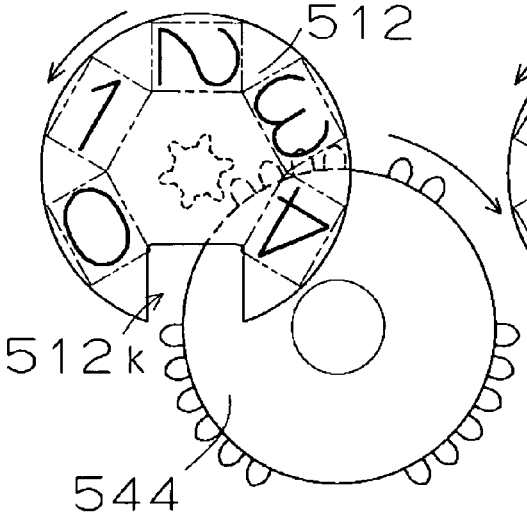
FIG. 18 illustrates partial plane views showing a state of indicating "5 day" according to the first embodiment of the timepiece with calendar mechanism of the invention.
Figure 18B:
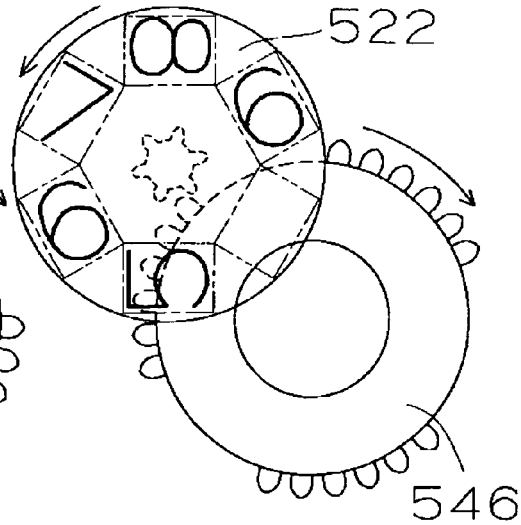
Figure 18C:
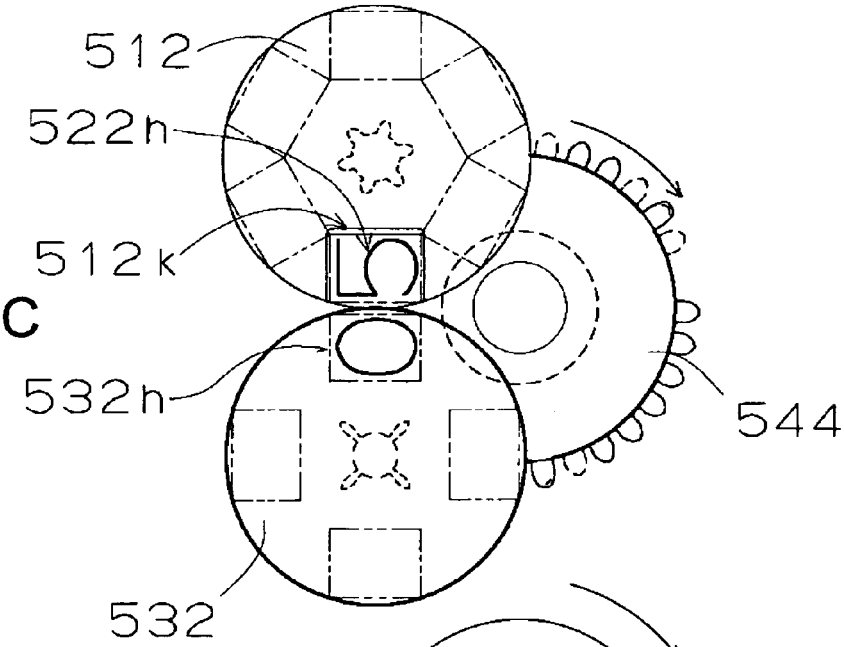
Figure 18D:
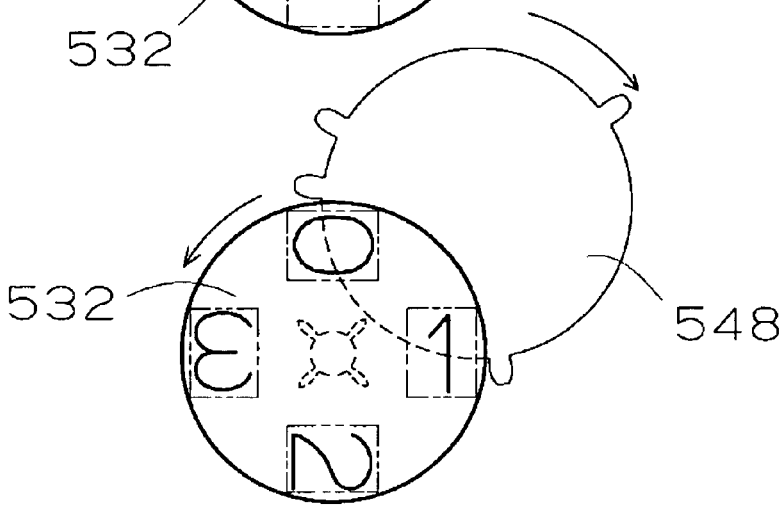
Figure 19A:
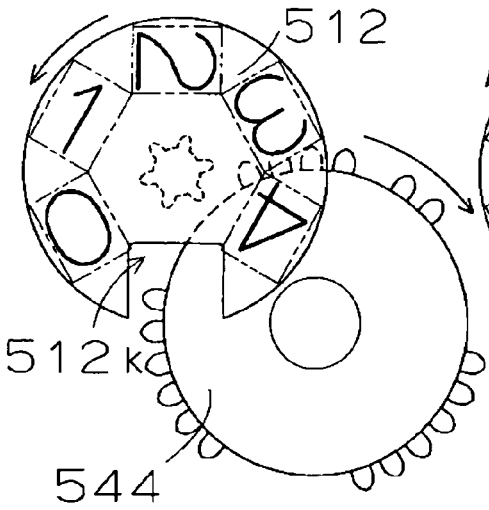
FIG. 19 illustrates partial plane views showing a state of indicating "6 day" according to the first embodiment of the timepiece with calendar mechanism of the invention.
Figure 19B:
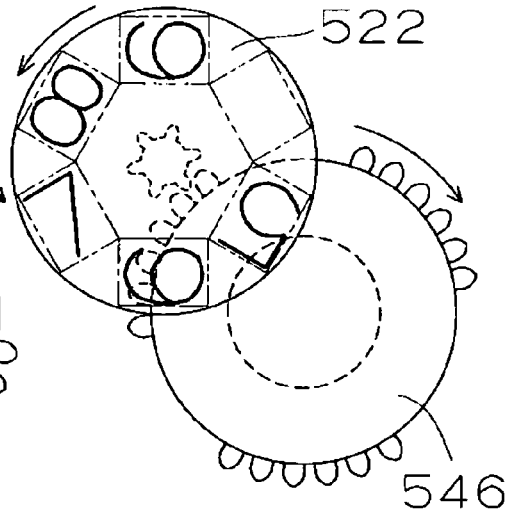
Figure 19C:
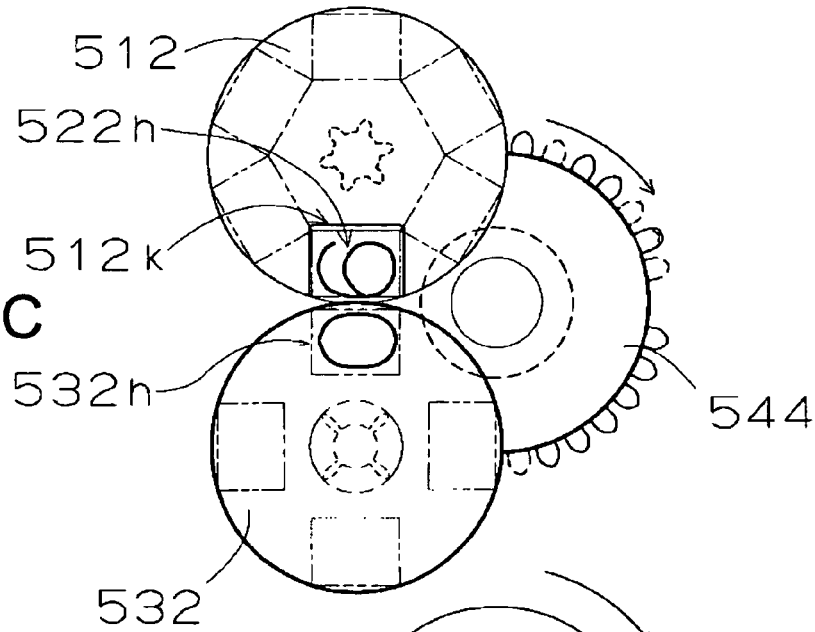
Figure 19D:
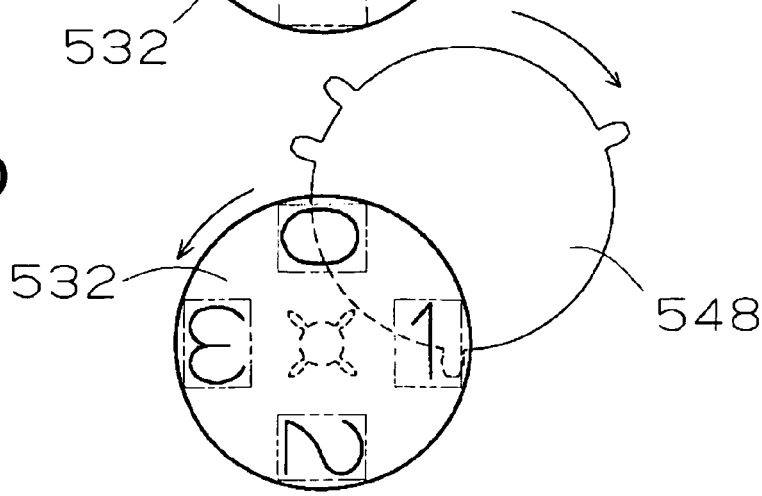
Figure 20A:
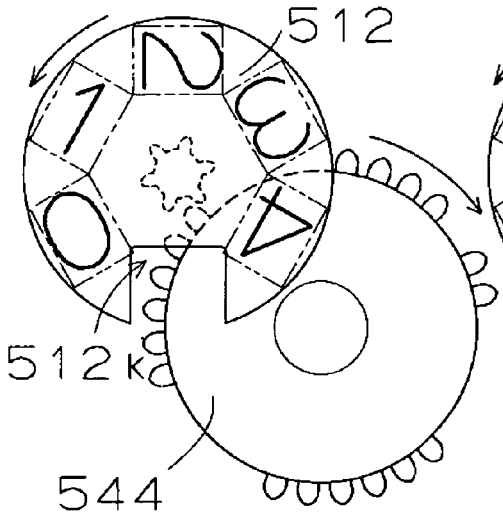
FIG. 20 illustrates partial plane views showing a state of indicating "9 day" according to the first embodiment of the timepiece with calendar mechanism of the invention.
Figure 20B:
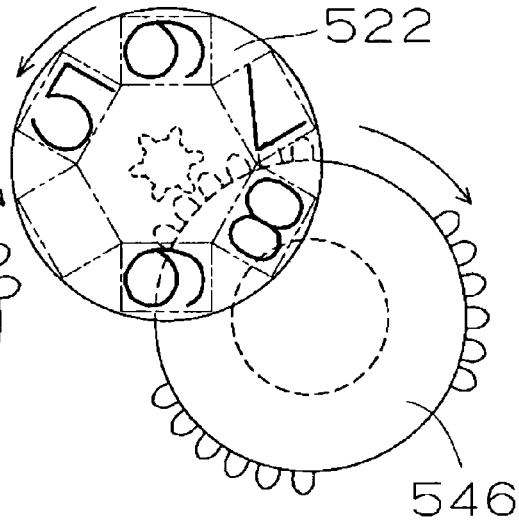
Figure 20C:
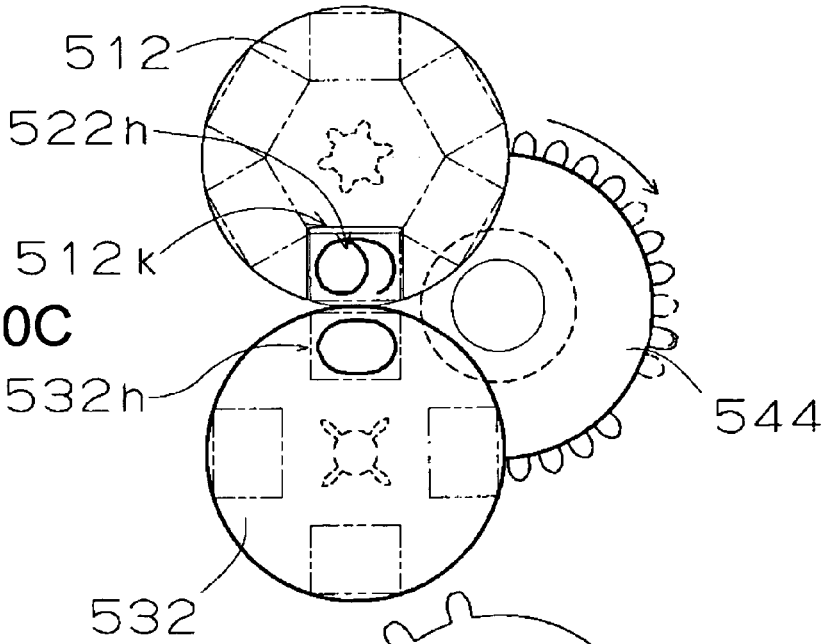
Figure 20D:
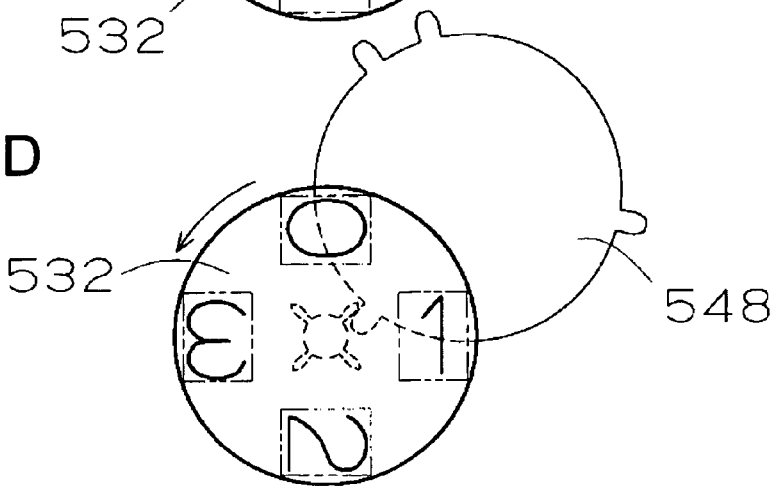
Figure 21A:
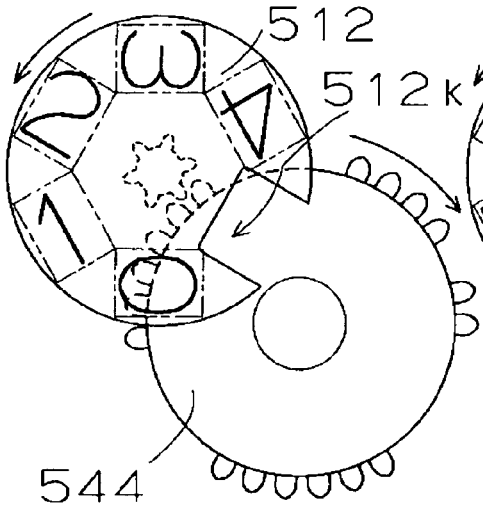
FIG. 21 illustrates partial plane views showing a state of indicating "10 day" according to the first embodiment of the timepiece with calendar mechanism of the invention.
Figure 21B:
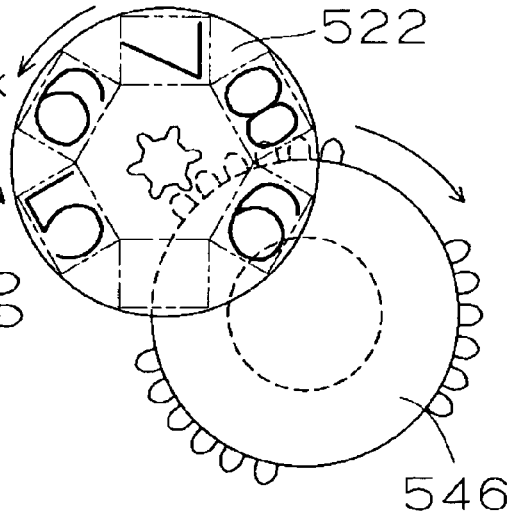
Figure 21C:
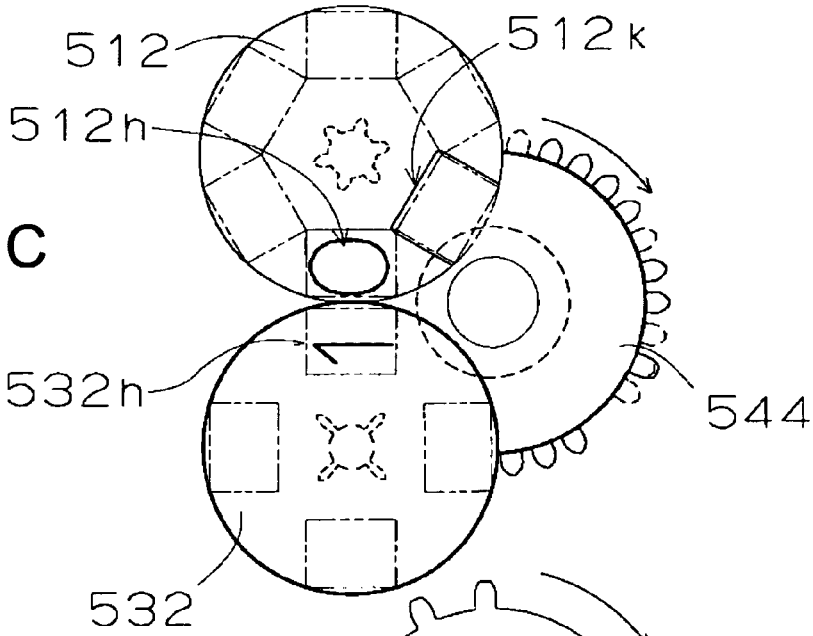
Figure 21D:
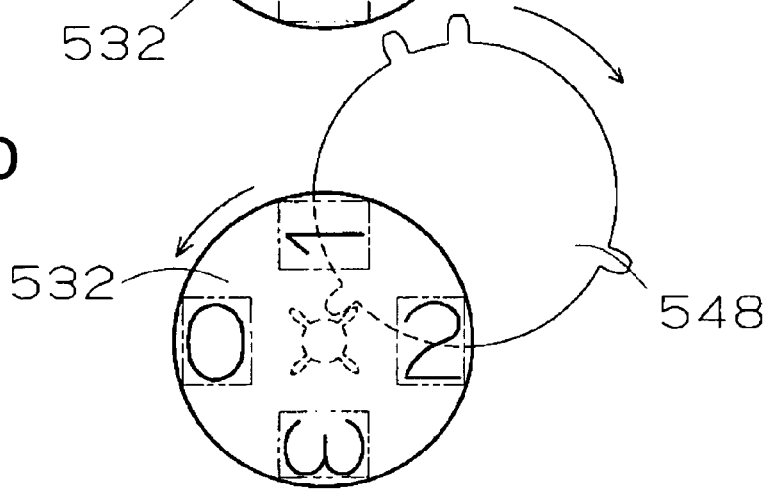
Figure 22A:
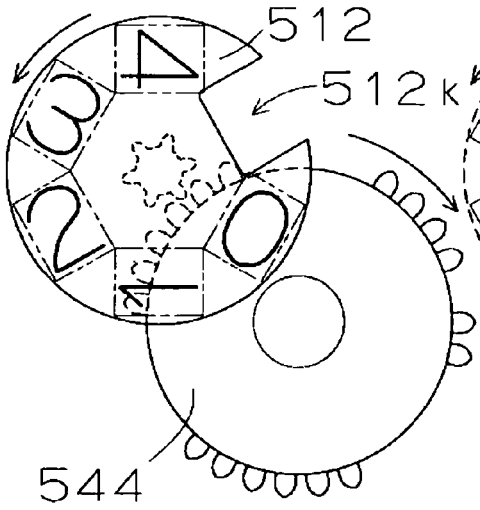
FIG. 22 illustrates partial plane views showing a state of indicating "11 day" according to the first embodiment of the timepiece with calendar mechanism of the invention.
Figure 22B:
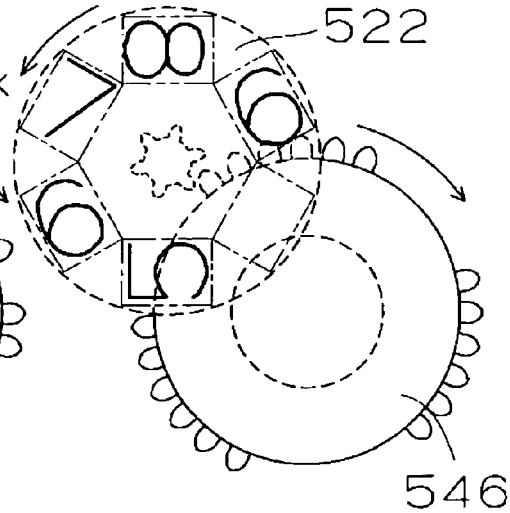
Figure 22C:
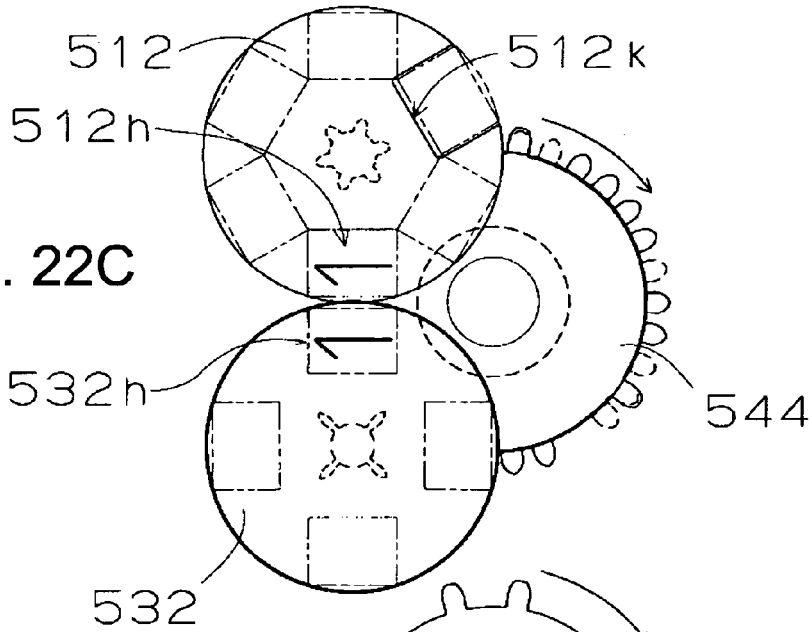
Figure 22D:
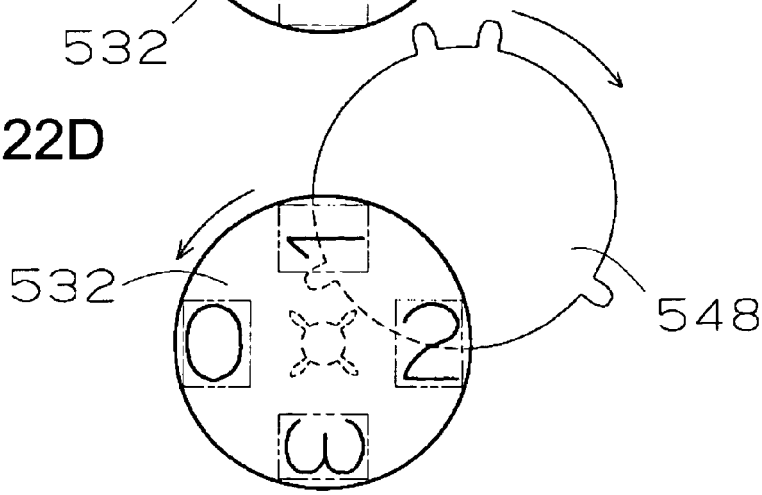

In reference to FIG. 11, the second program wheel 546 includes 18 pieces of second program wheel teeth portions 546*b* formed by an equal shape. Angular intervals of the second program wheel teeth portions 546*b* are 360/31 degrees, 360/31 degrees, 360/31 degrees, 360/31 degrees, 360/31 degrees, 5*360/31 degrees, 360/31 degrees, 360/31 degrees, 360/31 degrees, 360/31 degrees, 360/31 degrees, 5*360/31 degrees, 360/31 degrees, 360/31 degrees, 360/31 degrees, 360/31 degrees, 360/31 degrees, 360/31 degrees, 5*360/31 degrees.

In reference to FIG. 9, the third program wheel 548 includes 4 pieces of third program wheel teeth portions 548*b* formed by an equal shape. Angular intervals of the third program wheel teeth portions 548*b* are 10*360/31 degrees, 9*360/31 degrees, 2*360/31 degrees, 10*360/31 degrees.

Further, as shown by FIG. 28, a third program wheel 648 may be constituted to include 6 pieces of third program teeth portions 648*b* formed by an equal shape. Although according to the embodiment, angular intervals of the third program wheel teeth portions 648*b* are 9*360/31 degrees, 1*360/31 degrees, 8*360/31 degrees, 1*360/31 degrees, 2*360/31 degrees, 9*360/31 degrees, 1*360/31 degrees, the angular intervals may be A*360/31 degrees, B*360/31 degrees (A+B=10), C*360/31 degrees, D*360/31 degrees (C+D=9), 2*360/31 degrees, E*360/31 degrees, F*360/31 degrees (E+F=10).

By the constitution, a timepiece with calendar mechanism having large calendar indication and easy to see can be realized.

Figure 7A:
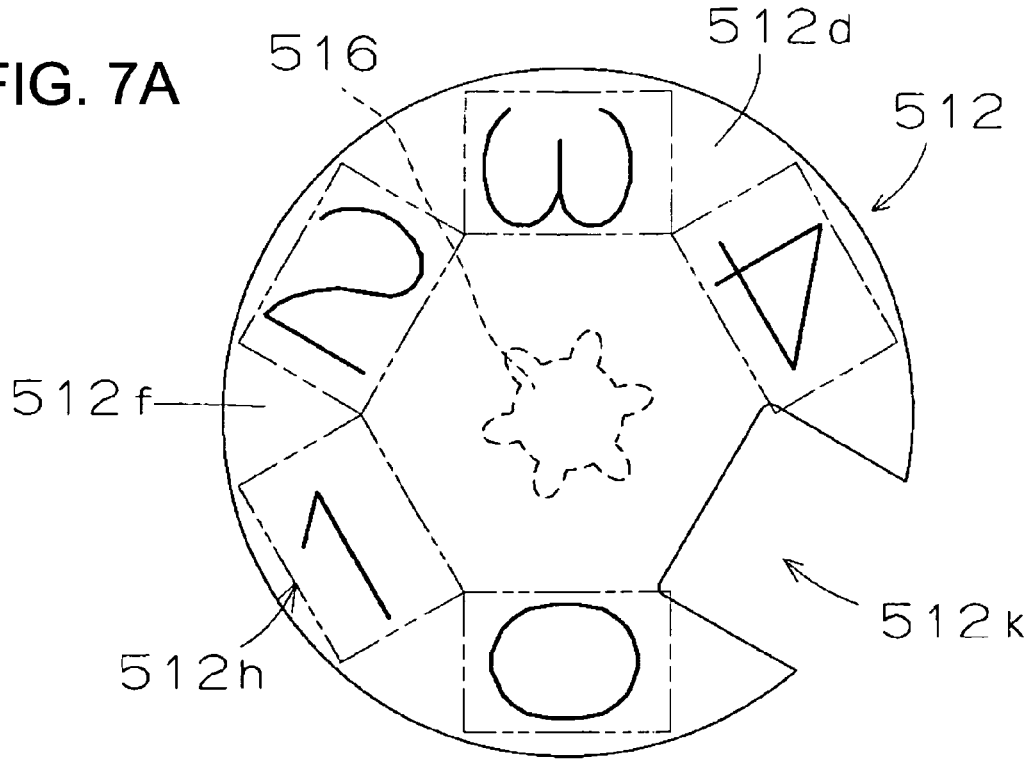
FIG. 7(*a*) is a plane view showing the first date indicator according to the first embodiment of the timepiece with calendar mechanism of the invention.
Figure 7B:
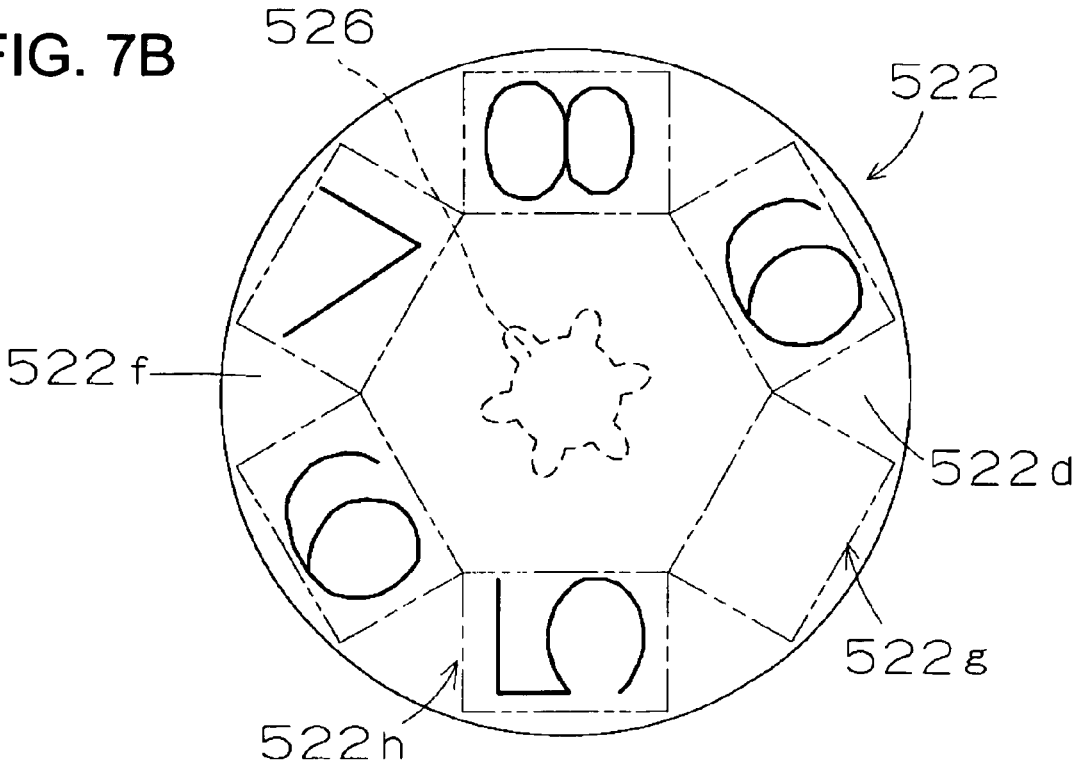

In reference to FIG. 7(*a*), the first date indicator 512 includes 6 pieces of first date indicator teeth portions 516 formed to constitute equal angular intervals. A first date character indicating face 512*f* is provided at an upper face of a first date plate 512*d*. First date characters 512*h* comprising 5 pieces of numerals are provided at the first date character indicating face 512*f*. The first date characters 512*h* include numerals in a circumferential direction in an order of "0", "1", "2", "3", "4". That is, the first date characters 512*h* are provided for indicating portions of a position of 1 of a date, that is, "0", "1", "2", "3", "4". 5 pieces of numerals constituting the first date characters 512*h* are arranged at the first date character indicating face 512*f* at equal angular intervals, that is, intervals of (360/6) degrees. A notch portion 512*k* is provided between "0" of the first date character 512*h* and "4" of the first date character 512*h*. The notch portion 512*k* is formed in an angular range of (360/6) degrees to correspond to a range for providing one character of the first date character 512*h*.

In reference to FIG. 7(*b*), the second date indicator 522 includes a second date plate 522*d* and 6 pieces of second date indicator teeth portions 526 formed to constitute equal angular intervals. A second date character indicating face 522*f* is provided at an upper face of the second date plate 522*d*. Second date characters 522*h* comprising 5 pieces of numerals and one piece of "solid portion" 522*g* are provided at the second date character indicating face 522*f*. The second date characters 522*h* are arranged in a circumferential direction in an order of "5 ", "6", "7", "8", "9". That is, the second date characters 522*h* are provided to indicate other portions of the position of 1 of the date, that is, "5", "6", "7", "8", "9". The "solid portion" 522*g* is arranged between "5" of the second date character 522*h* and "9" of the second date character 522*h*. 5 pieces of numerals constituting the second date characters 522*h* are arranged at the second character indicating face 522*f* at equal intervals, that is, at intervals of (360/6) degrees. The "solid portion" 522*g* is formed in an angular range of (360/6) degrees to correspond to a range of providing one character of the second date character 522*h*.

The first date characters 512*h* provided at the first character indicating face 512*f* may be started from any of consecutive numerals of "0" through "9". For example, the first date characters 512*h* may be 5 pieces of numerals of "8", "9", "0", "1", "2". In this case, the second date characters 522*h* provided at the upper face of the second date plate 522*d* may be arranged in the circumferential direction in an order of "3", "4", "5", "6", "7" of numerals of the consecutive numerals of "0" through "9" other than numerals illustrated on the first date character indicating face 512*f*.

Further, the first date character(s) 512*h* provided at the first date character indicating face 512*f* may be one numeral, or two or more and 8 or less of numerals of the consecutive numerals of "0" through "9". In this case, the second date characters 522*h* provided at the upper face of the second date plate 522*d* may be arranged with consecutive numerals of 2 or more and 8 or less of the consecutive numerals of "0" through "9" other than numerals illustrated on the first character indicating face 512*f*. By this construction, a size of a numeral indicating a date of the date indicator may be made to be larger than that of the background art. Therefore, according to the invention, a timepiece with calendar mechanism having a large calendar indication that is easy to see can be realized.

Figure 8:
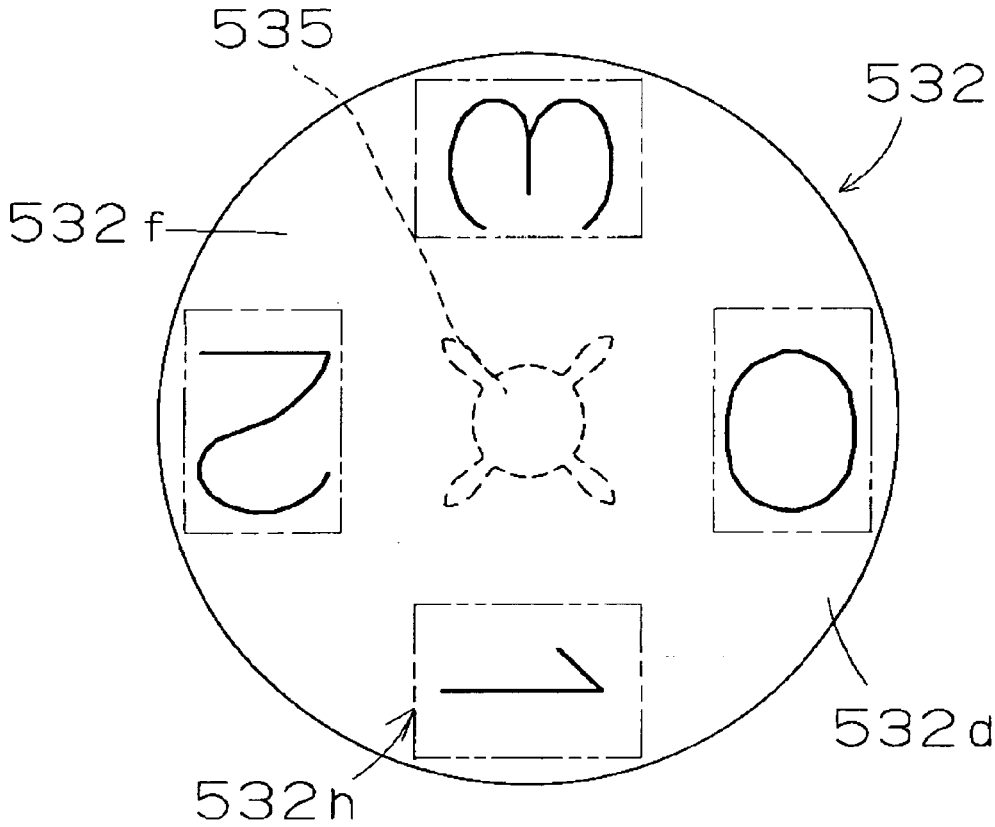
FIG. 8 is a plane view showing a third indicator according to the first embodiment of the timepiece with calendar mechanism of the invention.

In reference to FIG. 8, the third date indicator 532 includes a third date plate 532*d* and 4 pieces of third indicator teeth portions formed to constitute equal angular intervals. A third date character indicating face 532*f* is arranged at an upper face of the third date plate 532*d*. Third date characters 532*h* comprising 4 pieces of numerals are provided at a third date character indicating face 532*f*. The third date characters 532*h* include numerals in a circumferential direction in an order of "0", "1", "2", "3". That is, the third date indicator 532 is provided to indicate a position of 10 of the date, that is, "0", "1", "2", "3","4" pieces of numerals constituting the third date characters 532*h* are arranged at the third date character indicating face 532*f* at equal angular intervals, that is, at intervals of (360/4) degrees.

Further, as shown by FIG. 28, a third date indicator 632 may-be constituted to include a third date plate 632*d* and 6 pieces of third date indicator teeth portions formed to constitute equal intervals. A third date character indicating face 632*f* is provided at an upper face of the third date plate 632*d*. The third date characters 632*h* comprising 6 pieces of numerals are provided at the third date character indicating face 632*f*. The third characters 632*h* include numerals in a circumferential direction in an order of "0", "0", "1", "1", "2", "3". That is, the third date indicator 632 is provided to indicate a position of 10 of a date, that is "0", "1", "2", "3". 6 pieces of numerals constituting the third date characters 632*h* may be arranged at the third date character indicating face 632*f* at equal angular intervals, that is, at the intervals of (360/6).

Further, 6 pieces of numerals may be constituted by adding two of same numerals or different numerals to "0", "1", "2", "3" and "0", "1", "2", "3", to be "0", "0", "0", "1", "2", "3", or "0", "1", "1", "1", "2", "3".

By the constitution, a size of individual characters of the first date characters 512*h*, a size of individual characters of the second date characters 522*h*, a size of individual characters of the third date characters 532*h* are formed by equal dimensions and therefore, a calendar mechanism which is large and easy to be see can be realized.

The respective date plates can be formed by a metal of brass, aluminum or the like, or plastic of polyacetal or the like. Respective date characters can be formed by printing or the like. It is preferable to form an outer diameter of the first date wheel 512 by a dimension equal to an outer diameter of the second date indicator 522. Further, it is further preferable to form the outer diameter of the first date indicator 512, the outer diameter of the second date indicator 522 and an outer diameter of the third date indicator 532 by an equal dimension. It is preferable to form a size of individual characters of the first date characters 512*h*, a size of individual characters of the second date characters 522*h*, and a size of individual characters of the third date characters 532*h* by an equal dimension. By the constitution, the calendar mechanism which is large and easy to see can be realized.

In reference to FIG. 13, FIG. 13 shows a state of indicating that date is "29 day" by providing a date window at a position in 12 o'clock direction of the dial 104 in the timepiece with calendar mechanism of the invention, indicating "9" by the second date indicator 522 and indicating "2" by the third date indicator 532 from the date window.

In a state shown in FIG. 14, "0" of the first date character 512*h* is arranged at the date window 104*f* provided at the dial 104, when the date indicator 512 is rotated by one pitch in a direction indicated by an arrow mark, "1" in the first date characters 512*h* is constituted to be arranged at the date window 104*f*. In the following, similarly, when the first date indicator 512 is rotated by one pitch in the direction indicated by the arrow mark, one of the first date characters 512*h* is arranged at the date window 104*f* in an order of "2", "3", "4", next, the notch portion 512*k* is constituted to be arranged at the date window 104*f*. Further, when the first date indicator 512 is rotated by one pitch in the direction indicated by the arrow mark, "0" of the first date character 512*h* is constituted to be arranged at the date window 104*f* provided at the dial 104 again. By the constitution, the timepiece with calendar mechanism in which calendar indication is large and easy to see can be realized.

In the state shown in FIG. 14, the first date indicator 512 is disposed on the side of the dial and therefore, the second date character 522*h* cannot be seen from the date window 104*f*. When the second date indicator 522 is rotated by one pitch in the direction indicated by the arrow mark in a state of arranging the notch portion 512*k* at the date window 104*f*, one of the second date characters 522*h* is arranged at the date window 104*f* in an order of "5", "6", "7", "8", "9", next, the "solid portion" 522*g* is constituted to be arranged at the date window 104*f*. By the constitution, the timepiece with calendar mechanism in which calendar indication is large and easy to see can be realized.

In the state shown in FIG. 14, "3" of the third date characters 532*h* is arranged at the date window 104*f*, when the third date indicator 532 is rotated by one pitch in the direction indicated by the arrow mark, "0" arranged successive to "3" in the third date characters 532*h* is constituted to be arranged at the date window 104*f*. In the following, similarly, when the third date indicator 532 is rotated by one pitch in the direction indicated by the arrow mark, one of the third date characters 532*h* is constituted to be arranged at the date window 104*f* in an order of "1", "2", "3", "0". Or, there can be constructed a constitution in which in the third date indicator 532, instead of providing numeral "0", the position is constituted by a portion of "white paper", (that is, a solid portion which is not provided with any numeral). By the constitution, a timepiece with calendar mechanism in which indication of a calendar is large and easy to see can be realized.

The state shown in FIG. 14 is a state in which "3" in the third date characters 532*h* is arranged at a portion on a left side of the date window 104*f*, further, "0" in the first date characters 512*h* is arranged at a portion on a left side of the date window 104*f*. It is preferable to arrange the third date character indicating face 532*f* to a position more proximate to the dial 104 than the first date character indicating face 512*f*, further, to arrange a position more remote from the dial 104*f* than the second date character indicating face 522*f* (refer to FIG. 3). By the constitution, both of a stepped difference between the third date character indicating face 532*f* and the first date indicating face 512*f* and a stepped difference between the third date character indicating face 532*f* and the second date character indicating face 522*f* can be minimized.

Figure 23:
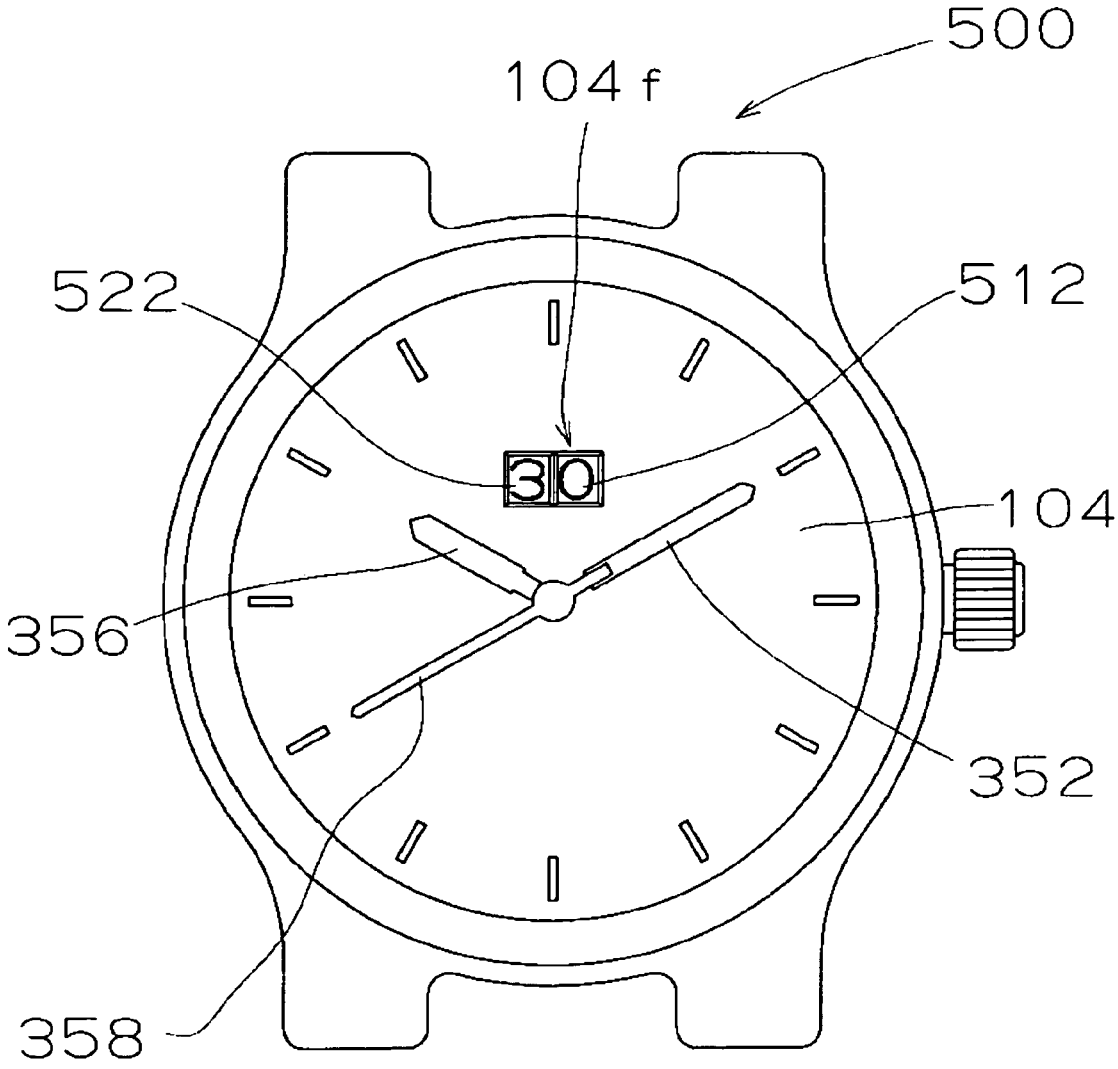
FIG. 23 is a plane view showing a complete in a state of indicating "30 day" in a constitution of arranging a date window in 12 o'clock direction of a dial according to the first embodiment of the timepiece with calendar mechanism of the invention.

In reference to FIG. 23, a complete 500 of the timepiece with calendar mechanism according to the invention is formed with the date window 104*f* at 12 o'clock position of the dial 104. In the complete 500, the portion on the left side of the date window 104*f* of the dial 104 is arranged with "3" in the third date characters 532*h* of the third date indicator 532, the portion on the right side of the date window 104*f* is arranged with "0" in the first date characters 512*h* of the first date indicator 512. Therefore, FIG. 23 shows a state in which the complete 500 indicates "30 day" by the third date character 532*h* of the third date indicator 532 and the first date character 512*h* of the first date indicator 512.

In reference to FIG. 1 through FIG. 4 and FIG. 13, by rotating the hour wheel & pinion 354, the date driving wheel 510 is rotated by way of rotation of the intermediate first date driving wheel 530, the intermediate second date driving wheel 531, the date driving finger 511 rotates the program wheel & pinion 540 by an amount of one tooth in the clockwise direction by once per day. By rotating the program wheel & pinion 540, the first program wheel 544 rotates the first date indicator 512 in the counterclockwise direction by an amount of one teeth, and a portion of the first date character indicating face 512*f* of the first date indicator 512 arranged at the date window 104*f* can be changed from the notch portion 512*k* to date character "0". Rotation of the first date indicator 512 by the amount of one tooth is rectified by the first date indicator jumper 514. Simultaneously with rotating the first date indicator 512 by the first program wheel 544, the second program wheel 546 rotates the second date indicator 522 in the counterclockwise direction by an amount of one tooth, and the date character arranged below the date window 104*f* by the second date indicator 522 can be changed from "9" to then "solid portion" 522*g*. Rotation of the second date indicator 522 by the amount of one tooth is rectified by the second date indicator jumper 524.

Further, simultaneously with rotating the first date indicator 512 by the first program wheel 544, the third program wheel 548 rotates the third date indicator 532 in the counterclockwise direction by an amount of one tooth, and the date character arranged below the date window 104*f* of the third date indicator 532 can be changed from "2" to "3". Rotation of the third date indicator 532 by the amount of one tooth is rectified by the third date indicator jumper 533. As shown by FIG. 14, by the date driving operation, "30 day" can be indicated from the date window 104*f* by the third date indicator 532 and the first date indicator 512 by indicating "3" by the second date character 532*h* of the third date indicator 532 and indicating "0" by the first date character 512*h* of the first date indicator 512. The date driving operation may be constituted to finish when the hour hand 356 and the minute hand 352 indicate 12 o'clock 0 minute.

(1.6) Constitution of Calendar Correcting Mechanism:

In reference to FIG. 1 through FIG. 3, a calendar correcting mechanism includes a first calendar corrector setting wheel 590, a second calendar corrector setting wheel 591, and a calendar corrector setting wheel 592. The calendar corrector setting wheel 592 is constituted to be able to be pivoted along a guide hole provided at the main plate 102. When the hand setting stem 310 is pulled from 0 stage to 1 stage, a wheel portion of the setting wheel 376 is constituted to be able to be brought in mesh with a wheel portion of the first calendar corrector setting wheel 590 by rotating the setting wheel operating lever 374 based on rotation of the setting lever 370. Further, when the hand setting stem 310 is pulled from 0 stage to 1 stage, an inner side wheel of the clutch wheel 311 is constituted to be able to be brought in mesh with a wheel portion of the setting wheel 376 by rotating the yoke 371 based on rotation of the setting lever 370.

When the hand setting stem 310 is rotated in a first direction in a state of pulling the hand setting stem 310 to 1 stage, the clutch wheel 311 is rotated, the second calendar corrector setting wheel 591 is rotated by rotation of the setting wheel 376, the first calendar corrector setting wheel 590, the calendar corrector setting wheel 592 is pivoted in the counterclockwise direction by rotation of the second calendar corrector setting wheel 591, a wheel portion of the calendar corrector setting wheel 592 is rotated to a position of being brought in mesh with the teeth portion of the program date indicator 542 to be stopped thereby, and the calendar corrector setting wheel 592 is constituted to rotate at the calendar correcting position. When the calendar corrector setting wheel 592 is rotated at the calendar correcting position, the calendar corrector setting wheel 592 is constituted to be able to rotate the program wheel 540 in the clockwise direction.

When the hand setting stem 310 is rotated in a second direction reverse to the first direction in the state of pulling the hand setting stem 310 to 1 stage, the clutch wheel 311 is rotated, the second calendar corrector setting wheel 591 is rotated by rotation of the setting wheel 376, the first calendar corrector setting wheel 590, the calendar corrector setting wheel 592 is pivoted in the clockwise direction by rotation of the second calendar corrector setting wheel 591, the wheel portion of the calendar corrector setting wheel 592 is rotated to a position of not being brought in mesh with the teeth portion of the program date wheel 542 to stop at an idling position. The program wheel 540 is constituted not to be able to be rotated not even when the calendar corrector setting wheel 592 is rotated at the idling position.

When the hand setting stem 310 is rotated in the first direction in the state of pulling the hand setting stem 310 to 1 stage, the program wheel 540 is rotated in the clockwise direction by an amount of one tooth by rotating the calendar corrector setting wheel 592 by way of rotation of the clutch wheel 311, the setting wheel 376, the first calendar corrector setting wheel 590, the second calendar corrector setting wheel 591, the second program wheel 546 can rotate the second date indicator 522 in the counterclockwise direction by the amount of one tooth by the teeth portion, and the third program wheel 548 is constituted to be able to rotate the third date indicator 532 in the counterclockwise direction by the amount of one tooth by the teeth portion.

The timepiece with calendar mechanism according to the invention is constructed by a constitution of indicating from "1 day" to "31 day" each month and therefore, date correction at end of month is carried out only at end of February, end of April, end of June, end of September, end of November. Therefore, according to the timepiece with calendar mechanism of the invention, a frequency of carrying out date correction at end of month can be constituted by 5 times in one year.

(1.7) Normal Hand Operation:

Next, normal operation of hand of the timepiece with calendar mechanism of the invention will be explained. In reference to FIG. 3 through FIG. 6 and FIG. 12, the main spring (not illustrated) integrated to the barrel complete 320 constitutes a power source of the timepiece. By winding back (releasing) the mainspring, the barrel wheel 320*d* of the barrel complete 320 is rotated in one direction to indicate time information by indicators (hour hand, minute hand, second hand or the like) by way of rotation of the top train wheel and the bottom train wheel. Rotation of the barrel wheel 320*d* rotated by power of the main spring is controlled by a speed control apparatus and an escapement apparatus. The speed control apparatus includes the balance with hairspring 340. The escapement apparatus includes the pallet fork 342 and the escape wheel & pinion 330. The second wheel & pinion 325 is rotated by rotation of the barrel wheel 320*d*. By rotation of the second wheel & pinion 325, the third wheel & pinion 326 is rotated. By rotation of the third wheel & pinion 326, the fourth wheel & pinion 328 is rotated by one rotation per 1 minute.

A rotation speed of the fourth wheel & pinion 328 is controlled by the escape wheel & pinion 330. A rotation speed of the escape wheel & pinion 330 is controlled by the pallet fork 342. Pivoting movement of the pallet fork 342 is controlled by the balance with hairspring 340. By rotation of the third wheel & pinion 326, the minute indicator 324 is rotated by one rotation per 1 hour. The minute hand 352 attached to the minute indicator 324 indicates "minute". The second hand 358 attached to the fourth wheel & pinion 328 indicates "second". The rotational center of the fourth wheel & pinion 328 and the rotational center of the date indicator 324 are constituted to be disposed at the same position. By rotation of the minute indicator 324, the minute wheel & pinion 348 is rotated. By rotation of the minute wheel & pinion 348, the hour wheel & pinion 354 is constituted to rotate by one rotation per 12 hours. The hour hand 356 attached to the hour wheel & pinion 354 indicates "hour".

(1.8) Winding Operation:

Operation of a hand winding mechanism will be explained in the timepiece with calendar mechanism of the invention as follows. In reference to FIG. 2, FIG. 5 and FIG. 6, the ratchet wheel 316 is supported to rotate integrally with the barrel stem of the barrel complete 320. The ratchet wheel 316 can be rotated only in a direction the same as the direction of rotating the barrel complete 320. A click 318 constituting a member of rectifying rotation of the ratchet wheel is provided at the barrel complete 360 for rectifying rotation of the ratchet wheel 316 only in one direction. By the click 318, the ratchet wheel 316 can be hampered from rotating in the direction reverse to the direction of rotating the barrel complete 320. When the clutch wheel 311 is rotated in one direction in a state in which the hand setting stem 310 is disposed at 0 stage, the winding pinion 312 is rotated, by rotation of the winding pinion 312, the ratchet wheel 316 is rotated in the clockwise direction by way of rotation of the crown wheel 313, a transmission crown wheel 314, the pivoting crown wheel 315. By rotating the clutch wheel 316, the main spring can be wound.

Next, operation of an automatic winding mechanism will be explained in the timepiece with calendar mechanism according to the invention. In reference to FIG. 3 through FIG. 6, according to the automatic winding mechanism, the first reduction wheel 212 is rotated based on the oscillating weight 210 and rotation of the oscillating weight 210. The second reduction wheel 216 is rotated based on rotation of the first reduction wheel 212. The switch transmission pinion of the switch transmission wheel 220 is rotated only in one direction based on rotation of the first reduction wheel 212 and the second reduction wheel 216. Based on rotation of the switch transmission pinion, the ratchet wheel 316 can be rotated only in one direction by way of rotation of the first transmission wheel 250, the second transmission wheel 252, the third transmission wheel 254. By rotating the ratchet wheel 316, the main spring at inside of the barrel complete 320 can be wound up only in one direction.

(1.9) Hand Setting Operation:

Next, operation when hand setting is carried out will be explained in the timepiece with calendar mechanism according to the invention. When the hand setting stem 310 is pulled out to 2 stage from the state shown in FIG. 2, the clutch wheel 311 is rotated based on rotation of the hand setting stem 310. That is, when the hand setting stem 310 is rotated in the state of pulling out the hand setting stem 310 to 2 stage, the setting wheel 376 is rotated based on rotation of the clutch wheel 311. The minute wheel & pinion 348 is rotated based on rotation of the clutch wheel 376. Therefore, when the hand setting stem 310 is disposed at 2 stage, by rotating the hand setting stem 310, "hand setting" can be carried out. That is, when the hand setting stem 310 is disposed at 2 stage, by rotating the hand setting stem 310, the hour wheel & pinion 354 is rotated, a content of indicating "hour" indicated by the hour hand 356 attached to the hour wheel & pinion 354 is corrected, at the same time, a content of indicating "minute" indicated by the minute hand 352 attached to the minute indicator 324 can be corrected by rotating the minute indicator 324.

(1.10) Calendar Driving Operation:

Next, a calendar driving operation of the timepiece with calendar mechanism according to the invention will be explained. In reference to FIG. 13, a state shown in FIG. 13 is a state of indicating that the date is "29 day" by providing the date window at the position in 12 o'clock direction of the dial 102, indicating "9" by the second date indicator 522 from the date window and indicating "2" by the third date indicator 532. Therefore, the state shown in FIG. 13 is a state of indicating "29 day" by the third date character 532*h* of the third date indicator 532 and the second date character 522*h* of the second date indicator 522 in the complete 500.

In reference to FIG. 1 through FIG. 4 and FIG. 13, by rotating the hour wheel & pinion 354, the date driving wheel 510 is rotated by way of rotation of the intermediate first date driving wheel 530, the intermediate second date driving wheel 531, the date driving finger 511 rotates the program wheel & pinion 540 in the clockwise direction by the amount of one tooth by one time per 1 day. By rotating the program wheel & pinion 540, the first program wheel 544 rotates the first date indicator 512 in the counterclockwise direction by the amount of one tooth, and the portion of the first date character indicating face 512*f* of the first date indicator 512 arranged at the date window 104*f* is changed from the notch portion 512*k* to the date character "0". Rotation of the first date indicator 512 by the amount of one tooth is rectified by the first date indicator jumper 514. Simultaneously with rotating the first date indicator 512 by the first program wheel 544, the second program wheel 546 rotates the second date indicator 522 in the counterclockwise direction by the amount of one tooth, and the date character of the second date indicator 522 arranged under the date window 104*f* is changed from "9" to the "solid portion" 522*g*. Rotation of the second date indicator 522 by the amount of one tooth is rectified by the second date indicator jumper 524.

Simultaneously with rotating the first date indicator 512 by the first program wheel 544, the third program wheel 548 rotates the third date indicator 532 in the counterclockwise direction by the amount of one tooth, and the date character of the third date indicator 532 arranged under the date window 104*f* is changed from "2" to "3". Rotation of the third date indicator 532 by the amount of one tooth is rectified by the third date indicator jumper 533. As shown by FIG. 14, by the date driving operation, "3" can be indicated by the third date character 532*h* of the third date wheel 532, "0" can be indicated by the first date character 512*h* of the first date wheel 512, and "30 day" can be displayed from the date window 104*f* by the third date indicator 532 and the first date indicator 512. The date driving operation is finished when the hour hand 356 and the minute hand 352 indicate 12 o'clock 0 minute.

In reference to FIG. 1 through FIG. 4 and FIG. 14, further, by rotating the hour wheel & pinion 354, the date driving wheel 510 is rotated by way of rotation of the intermediate first date driving wheel 530, the intermediate second date driving wheel 531, the date driving finger 511 rotates the program wheel 540 in the clockwise direction by the amount of one tooth by one time per 1 day. By rotating the program wheel & pinion 540, the first program wheel 544 rotates the first date indicator 512 in the counterclockwise direction by the amount of one tooth, and the date character "0" of the first date wheel 512 arranged at the date window 104*f* is changed to "1". Rotation of the first date indicator 512 by the amount of one tooth is rectified by the first date wheel jumper 514.

Simultaneously with rotating the first date indicator 512 by the first program wheel 544, the second program wheel 546 rotates the second date indicator 522 by the amount of one tooth in the counterclockwise direction, and the "solid portion" 522*g* of the second date wheel 522 arranged under the date window 104*f* is changed to the date character "5". Rotation of the second date wheel 522 by the amount of one tooth is rectified by the second date indicator jumper 524. When the first program wheel 544 rotates the first date indicator 512, the third program wheel 548 does not rotate the third date indicator 532 but the date character of the third date indicator 532 arranged under the date window 104*f* stays to be "3". Rotation of the third date indicator 532 is rectified by the third date indicator jumper 533. As shown by FIG. 15, by the date driving operation, "3" can be indicated by the third date character 532*h* of the third date indicator 532, "1" can be indicated by the first date character 512*h* of the first date indicator 512, and "31 day" can be indicated by the third date indicator 532 and the first date indicator 512.

In reference to FIG. 1 through FIG. 4 and FIG. 15, further, by rotating the hour wheel & pinion 354, the date driving wheel 510 is rotated by way of rotation of the intermediate first date driving wheel 530, the intermediate second date driving wheel 531, and the date driving finger 511 rotates the program wheel & pinion 540 in the clockwise direction by the amount of one tooth by one time per 1 day. By rotating the program wheel & pinion 540, the first program wheel 544 does not rotate the first date wheel 512 but the date character of the first date indicator 512 arranged under the date window

104*f* stays to be "1". Rotation of the first date indicator 512 is rectified by the first date indicator jumper 514. By rotating the program wheel & pinion 540, the second program wheel 546 does not rotate the second date wheel 522 but the date character of the second date indicator 522 arranged under the date window 104*f* stays to be "5".

Rotation of the second date indicator 522 is rectified by the second date indicator jumper 524. By rotating the program wheel & pinion 540, the third program wheel 548 rotates the third date indicator 532 in the counterclockwise direction by the amount of one tooth, and the date character of the third date indicator 532 arranged under the date window 104*f* is changed from "3" to "0". Rotation of the third date indicator 532 is rectified by the third date indicator jumper 533. As shown by FIG. 16, by the date driving operation, "0" can be indicated by the third date character 532*h* of the third date indicator 532, "1" can be indicated by the first date character 512*h* of the first date indicator 512, and "01 day" (that is, "1 day") can be indicated by the third date indicator 532 and the first date indicator 512 from the date window 104*f*.

In reference to FIG. 1 through FIG. 4 and FIG. 16, further, by rotating the hour wheel & pinion 354, the date driving wheel 510 is rotated by way of rotation of the intermediate first date driving wheel 530, the intermediate second date driving wheel 531, and the date driving finger 511 rotates the program wheel & pinion 540 in the clockwise direction by the amount of one tooth by one time per 1 day. By rotating the program wheel & pinion 540, the first program wheel 544 rotates the first date indicator 512 in the counterclockwise direction by the amount of one tooth, and the date character of the first date indicator 512 arranged under the date window 104*f* is changed from "1" to "2". At this occasion, the second program wheel 546 does not rotate the second date indicator 522 but the date character of the second date indicator 522 arranged under the date window 104*f* stays to be "5", the third program wheel 548 does not rotate the third date indicator 532 but the date character of the second date indicator 522 arranged under the date window 104*f* stays to be "0".

Similarly, by rotating the program wheel & pinion 540, the date character of the first date indicator 512 arranged under the date window 104*f* is changed from "2" to "3". Further, by rotating the program wheel & pinion 540, the date character of the first date indicator 512 arranged under: the date window 104*f* is changed from "3" to "4". As shown by FIG. 17, by the date driving operation, "0" can be indicated by the third date character 532*h* of the third date indicator 532, "4" can be indicated by the first date character 512*h* of the first date indicator 512, and "04 day" (that is, "4 day") can be indicated from the date window 104*f* by the third date indicator 532 and the first date indicator 512.

In reference to FIG. 1 through FIG. 4 and FIG. 17, by rotating the hour wheel & pinion 354, the date driving wheel 510 is rotated by way of rotation of the intermediate first date driving wheel 530, the intermediate second date driving wheel 531, and the date driving finger 511 rotates the program wheel & pinion 540 in the clockwise direction by the amount of one tooth by one time per 1 day. By rotating the program wheel & pinion 540, the first program wheel 544 rotates the first date indicator 512 in the counterclockwise direction by the amount of one tooth, and the portion of the first date indicator 512 arranged under the date window 104*f* is changed from "0" to the notch portion 512*k*. Rotation of the first date indicator 512 by the amount of one tooth is rectified by the first date indicator jumper 514. At this occasion, the second program wheel 546 does not rotate the second date indicator 522 but the date character of the second date indicator 522 arranged under the date window 104*f* stays to be "5", the third program wheel 548 does not rotate the third date indicator 532 but the date character of the second date indicator 522 arranged under the date window 104*f* stays to be "0". As shown by FIG. 18, by the date driving operation, "0" can be indicated by the third date character 532*h* of the third date indicator 532, "5" can be indicated by the second date character 522*h* of the second date indicator 522, and "05 day", (that is, "5 day") can be indicated from the date window 104*f* of the third date indicator 532 and the second date indicator 522.

In reference to FIG. 1 through FIG. 4 and FIG. 18, by rotating the hour wheel & pinion 354, the date driving wheel 510 is rotated by way of rotation of the intermediate first date driving wheel 530, the intermediate second date driving wheel. 531, and the date driving finger 511 rotates the program wheel & pinion 540 in the clockwise direction by the amount of one tooth by one time per 1 day. By rotating the program wheel & pinion 540, the first program wheel 544 does not rotate the first date indicator 512 but the portion of the first date indicator 512 arranged under the date window 104*f* stays to be the notch portion 512*k*. Rotation of the first date indicator 512 is rectified by the first date indicator jumper 514. By rotating the program wheel 540, the second program wheel 546 rotates the second date indicator 522 in the counterclockwise direction by the amount of one tooth, and the date character of the second date indicator 522 arranged under the date window 104*f*. is changed from "5" to "6". At this occasion, the third program wheel 548 does not rotate the third date indicator 532 but the date character of the second date indicator 522 arranged under the date window 104*f* stays to be "0".

As shown by FIG. 19, by the date driving operation, "0" can be indicated by the third date character 532*h* of the third date indicator 532, "6" can be indicated by the second date character 522*h* of the second date indicator 522, and "06 day" (that is, "6 day") can be indicated from the date window 104*f* by the third date indicator 532 and the second date indicator 522. Similarly, by rotating the program wheel & pinion 540, the date character of the second date indicator 522 arranged under the date window 104*f* is changed from "6" to "7". Further, by rotating the program wheel & pinion 540, the date character of the second date indicator 522 arranged under the date window 104*f* is changed from "7" to "8". Further, by rotating the program wheel & pinion 540, the date character of the second date indicator 522 arranged under the date window 104*f* is changed from "8" to "9". As shown by FIG. 20, by the date driving operation, "0" can be indicated by the third date character 532*h* of the third date indicator 532, "9" can be indicated by the second date character 522*h* of the second date indicator 522, and "09 day" (that is, "9 day") can be indicated from the date window 104*f* by the third date indicator 532 and the second date indicator 522.

In reference to FIG. 1 through FIG. 4 and FIG. 20, further, by rotating the hour wheel & pinion 354, the date driving wheel 510 is rotated by way of rotation of the intermediate first date driving wheel 530, the intermediate second date driving wheel 531, and the date driving finger 511 rotates the program wheel & pinion 540 in the clockwise direction by the amount of one tooth by one time per 1 day. By rotating the program wheel 540, the first program wheel 544 rotates the first date indicator 512 in the counterclockwise direction by the amount of one tooth, and the portion of the first date indicator 512 arranged under the date window 104*f* is changed from the notch portion 512*k* to the date character "0". Rotation of the first date indicator 512 by the amount of one tooth is rectified by the first date indicator jumper 514.

Simultaneously with rotating the first date indicator 512 by the first program wheel 544, the second program wheel 546 rotates the second date indicator 522 in the counterclockwise direction by the amount of one tooth, and the date character "9" of the second date indicator 522 arranged under the date window 104*f* is changed to "solid portion" 522*g*. Rotation of the second date indicator 522 by the amount of one tooth is rectified by the second date indicator jumper 524. Simultaneously with rotating the first date indicator 512 by the first program wheel 544, the second program wheel 546 rotates the third date indicator 532 in the counterclockwise direction by the amount of one tooth, and the date character of the third date indicator 532 arranged under the date window 104*f* is changed from "0" to "1". Rotation of the third date indicator 532 is rectified by the third date indicator jumper 533. As shown by FIG. 21, by the date driving operation, "1" can be indicated by the third date character 532*h* of the third date indicator 532, "0" can be indicated by the first date character 512*h* of the first date indicator 512, and "10 day" can be indicated from the date window 104*f* by the third date indicator 532 and the first date indicator 512.

In reference to FIG. 1 through FIG. 4 and FIG. 21, further, by rotating the hour wheel & pinion 354, the date driving wheel 510 is rotated by way of rotation of the intermediate first date driving wheel 530, the intermediate second date driving wheel 531, and the date driving finger 511 rotates the program wheel & pinion 540 in the clockwise direction by the amount of one tooth by one time per 1 day. By rotating the program wheel & pinion 540, the first program wheel 544 rotates the first date indicator 512 in the counterclockwise direction by the amount of one tooth, and the date character "0" of the first date indicator 512 arranged under the date window 104*f* is changed to "1". Rotation of the first date indicator 512 by the amount of one tooth is rectified by the first date indicator jumper 514. Simultaneously with rotating the first date indicator 512 by the first program wheel 544, the second program wheel 546 rotates the second date wheel 522 in the counterclockwise direction by the amount of one tooth, and the portion of the second date indicator 522 arranged under the date window 104*f* is changed from the "solid portion" 522*g* to the date character "5". Rotation of the second date indicator 522 by the amount of one tooth is rectified by the second date indicator jumper 524.

At this occasion, the third program wheel 548 does not rotate the third date indicator 532 but the date character of the third date indicator 532 arranged under the date window 104*f* stays to be "1". As shown by FIG. 22, by the date driving operation, "1" can be indicated by the third date character 532*h* of the third date indicator 532, "1" can be indicated by the first date character 512*h* of the first date indicator 512, and "11 day" can be indicated from the date window 104*f* by the third date indicator 532 and the first date indicator 512.

The timepiece with calendar mechanism of the invention can carry out the above-described operation by one time everyday, the portion of the position of 1 of the date (that is, "0", "1", "2", "3", "4") can be indicated by the first date indicator 512, other portion of the position of 1 of the date (that is, "5", "6", "7", "8", "9") can be indicated by the second date indicator 522, and the position of 10 of the date (that is, "0", "1", "2", "3") can be indicated by the third date indicator 532 and therefore, "01 day" through "31 day" can be indicated from the date window 104*f* by large characters.

(1.11) Date Correcting Operation:

Next, an explanation will be given of operation when date is corrected in the timepiece with calendar mechanism according to the invention. In reference to FIG. 1 through FIG. 3, in the state of pulling the hand setting stem 310 to 1 stage, when the hand setting stem 310 is rotated in the first direction, the clutch wheel 311 is rotated, the second calendar corrector setting wheel 591 is rotated by rotation of the setting wheel 376, the first calendar corrector setting wheel 590, the calendar corrector setting wheel 592 is pivoted in the counterclockwise direction by rotation of the second calendar corrector setting wheel 591, the wheel portion of the calendar corrector setting wheel 592 is rotated to the position of being brought into contact with the teeth portion of the program date indicator 542 to stop, and the calendar corrector setting wheel 592 is rotated at the calendar correcting position. When the calendar corrector setting wheel 592 is rotated at the calendar correcting position, the program wheel & pinion 540 can be rotated in the clockwise direction by rotating the calendar corrector setting wheel 592.

In reference to FIG. 1 through FIG. 3 and FIG. 12, in the state of pulling the hand setting stem 310 to 1 stage, when the hand setting stem 310 is rotated in the first direction, the program wheel & pinion 540 is rotated in the clockwise direction by the amount of one tooth by rotating the calendar corrector setting wheel 592 by way of rotation of the clutch wheel 311, the setting wheel 376, the first calendar corrector setting wheel 590, the second calendar corrector setting wheel 591, the first program wheel 544 rotates the first date indicator 512 in the counterclockwise direction by the amount of one tooth, and the date character indicated from the date window 104*f* can be changed from "9" to "0" by the first date indicator 512. Simultaneously with rotating the first date indicator 512 by the first program wheel 544, the third program wheel 548 rotates the third date indicator 532 in the counterclockwise direction by the amount of one tooth, and the date character indicated from the date window 104*f* can be changed from "2" to "3" by the third date indicator 532. As shown by FIG. 14, when the correcting operation is carried out, "3" can be indicated by the third date character 532*h* of the third date indicator 532, "0" can be indicated by the first date character 512*h* of the first date indicator 512, and "30 day" can be indicated from the date window 104*f* by the third date indicator 532 and the first date indicator 512.

(2) Second Embodiment

Next, a second embodiment of a timepiece with calendar mechanism according to the invention will be explained. In the following explanation, a description will mainly be given of a point in which the second embodiment of the timepiece with calendar mechanism of the invention differs from the first embodiment of the timepiece with calendar mechanism of the invention. Therefore, the above-described explanation of the first embodiment of the timepiece with calendar mechanism of the invention will be applied to a portion which is not described below. The second embodiment of the timepiece with calendar mechanism according to the invention is an analog electronic timepiece.

Figure 24:
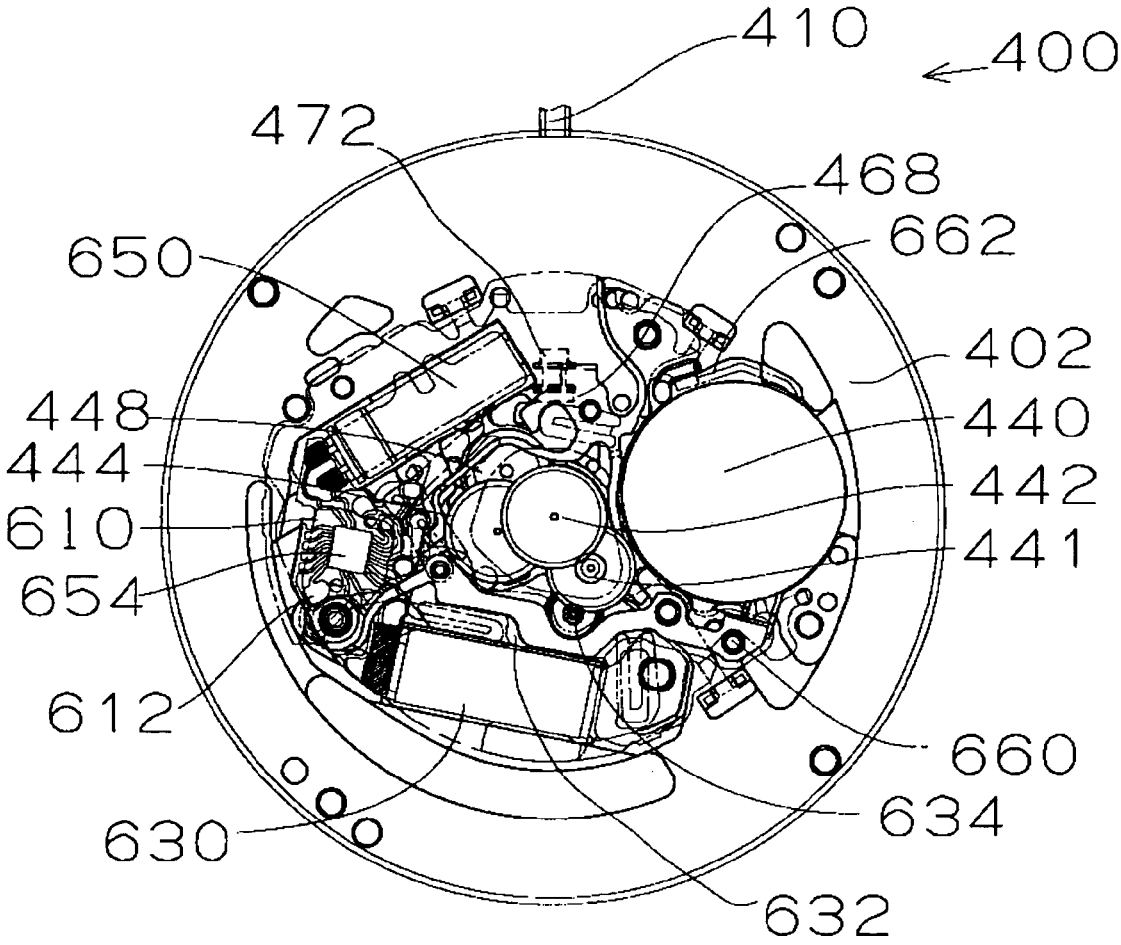
FIG. 24 is an outline plane view showing a structure when a movement is viewed from a case back side according to a second embodiment of a timepiece with calendar mechanism of the invention.
Figure 25:
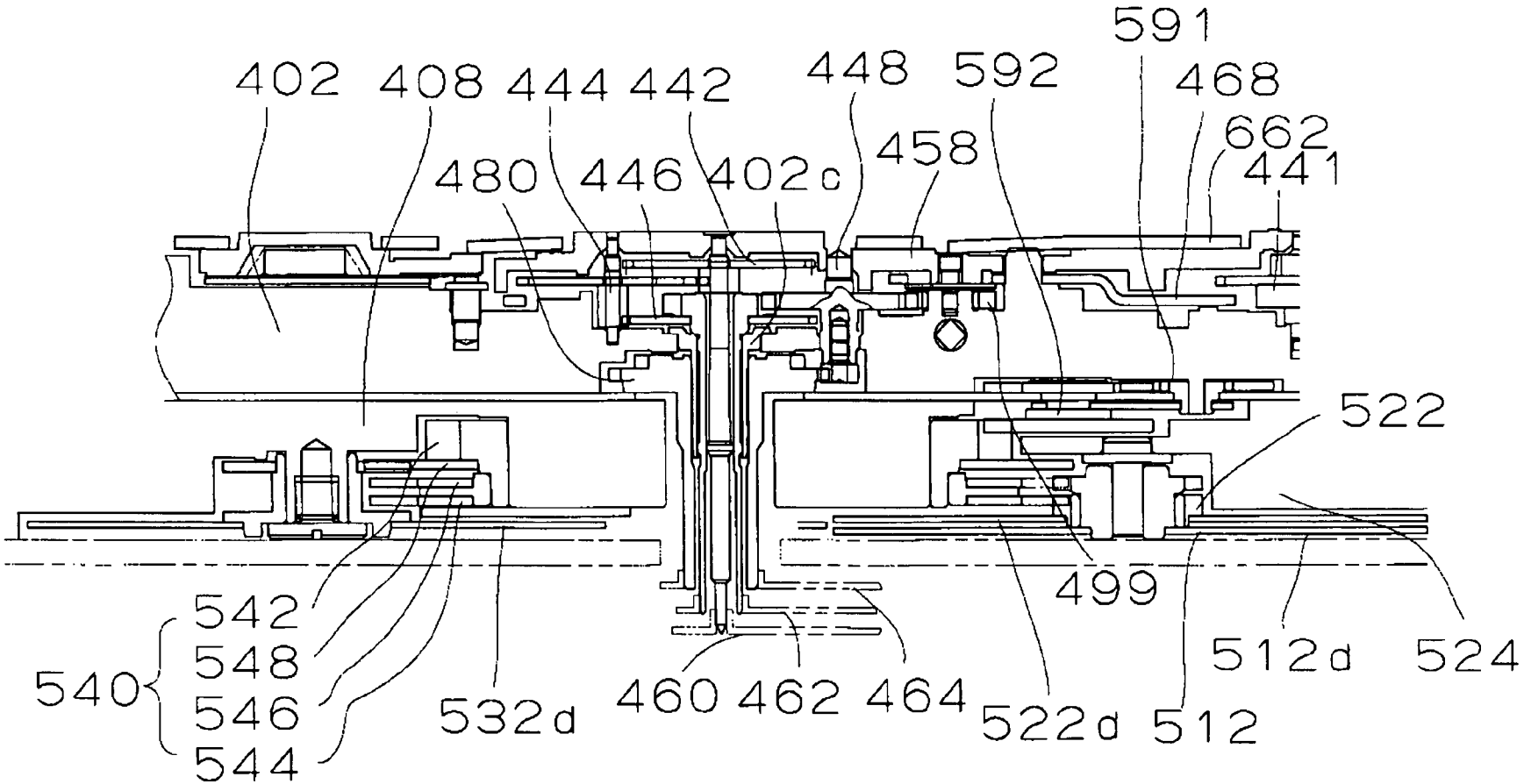
FIG. 25 is a partial sectional view showing a drive mechanism, a top train wheel, a calendar mechanism and the like according to the second embodiment of the timepiece with calendar mechanism of the invention.
Figure 26:
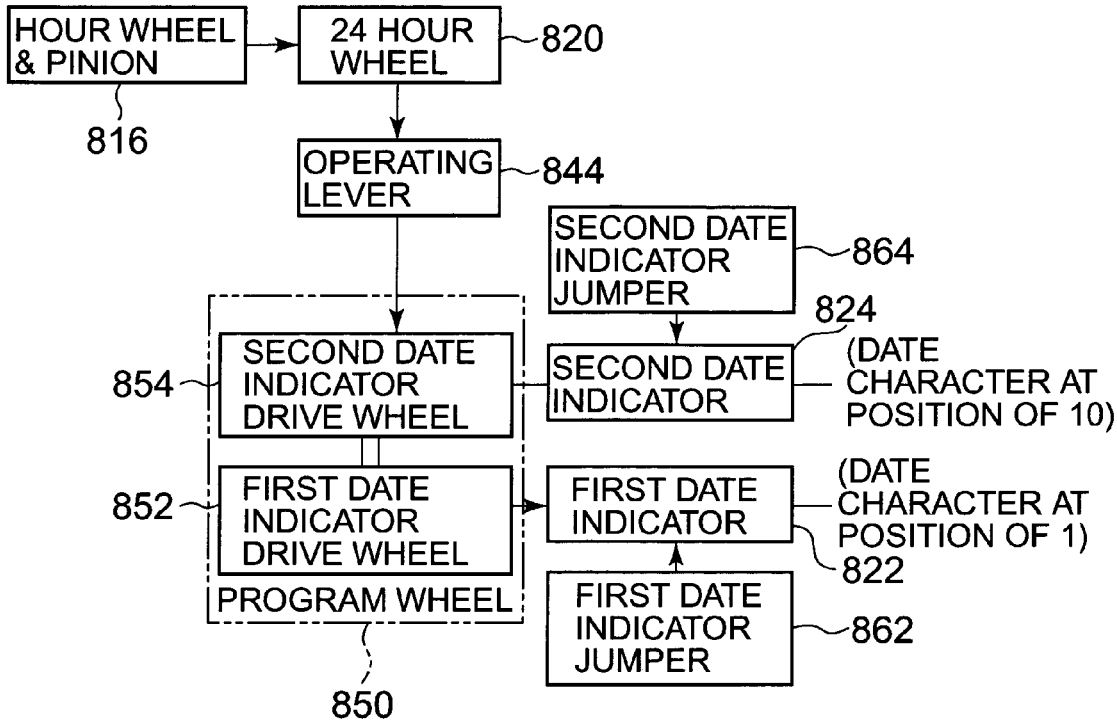
FIG. 26 is a block diagram showing a structure of a calendar mechanism according to a timepiece with calendar mechanism of a first type of a background art.
Figure 27:
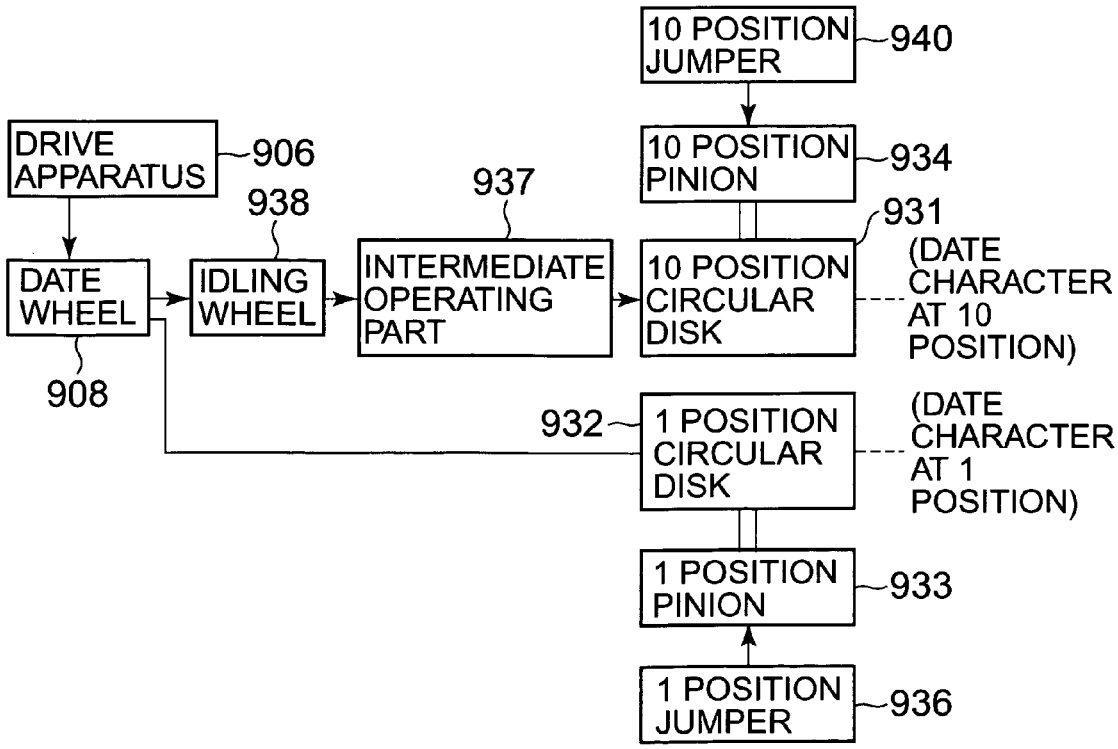
FIG. 27 is a block diagram showing a structure of a calendar mechanism according to a timepiece with calendar mechanism of a second type of a background art.
Figure 28A:
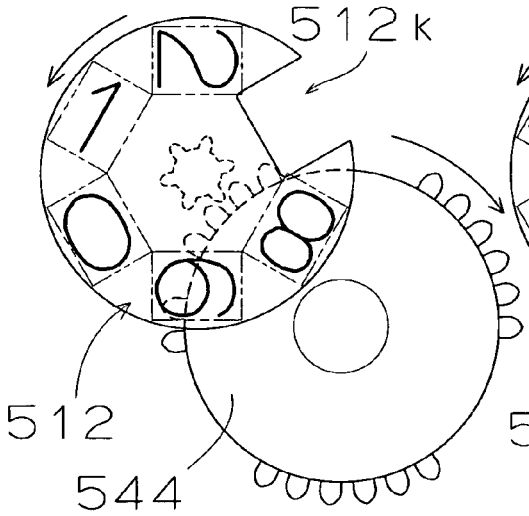
FIG. 28 illustrates partial plane views showing a state of indicating "9 day" according to a third embodiment of a timepiece with calendar mechanism of the invention.
Figure 28B:
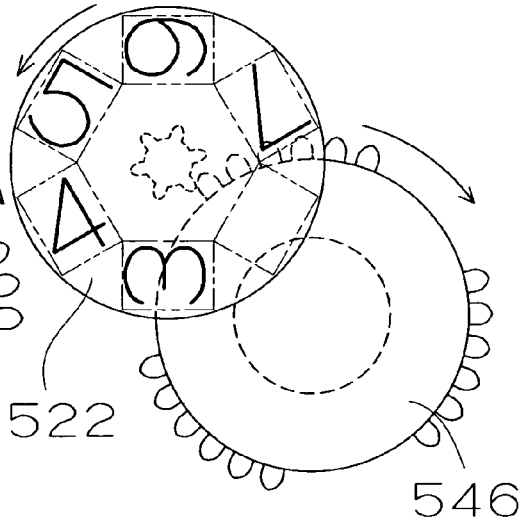
Figure 28C:
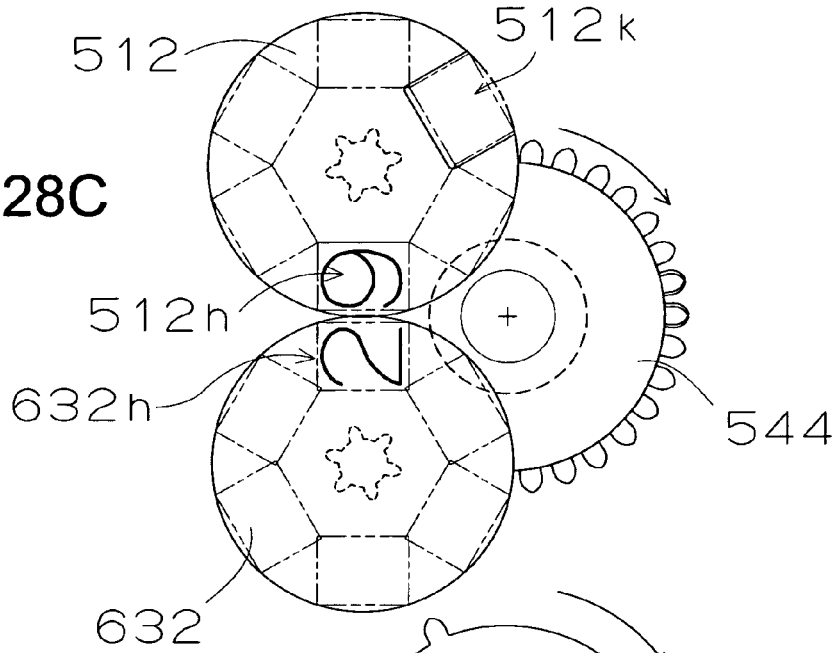
Figure 28D:
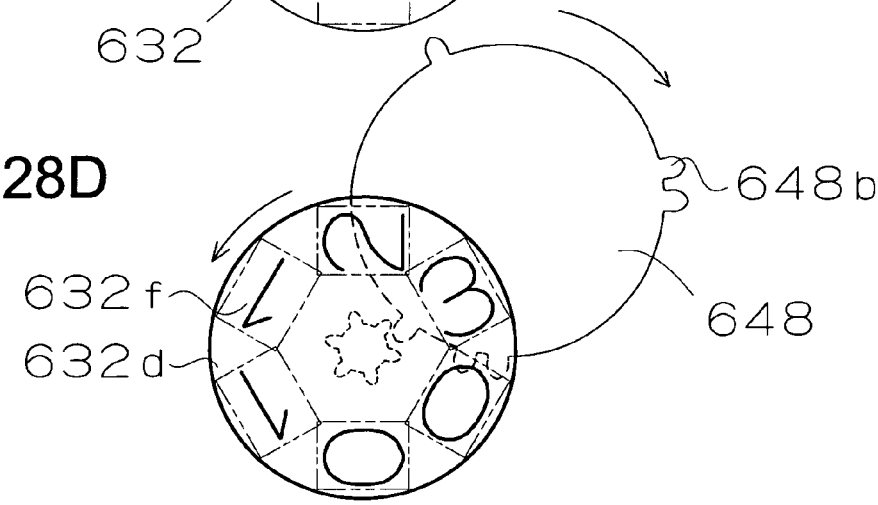

(2.1) Total Constitution of Movement:

In reference to FIG. 24 and FIG. 25, in the second embodiment of the timepiece with calendar mechanism according to the invention, a movement 400 is constituted by an analog electronic timepiece. The movement 400 includes a main plate 402 constituting a base plate of the movement 400. A dial 404 is attached to the movement 400. A hand setting stem 410 is rotatably integrated to the main plate 402. A clutch wheel 472 is arranged, to be provided with a rotation axis line the same as a rotation axis line of the hand setting stem 410. A battery 440 constituting a power source of the timepiece is arranged on a case back side (top side) of the main plate 402. A quartz unit 650 constituting an oscillation source of the timepiece is arranged on the case back side of the main plate 402. For example, a crystal oscillator oscillated at 32,768 Hertz is contained in the quartz unit 650.

An oscillating portion (oscillator) for outputting a reference signal based on oscillation of the crystal oscillator, a dividing control portion for controlling operation of a step motor by dividing an output signal of the oscillating portion, and a motor driving portion (driver) for outputting a motor drive signal for driving the step motor based on an output signal of the dividing control portion are included in an integrated circuit (IC) 654. The integrating circuit 654 is constituted by, for example, C-MOS or PLA. When the integrating circuit 654 is constituted by C-MOS, the oscillating portion, the dividing control portion, and the motor driving portion are included in the oscillating circuit 654. When the integrated circuit (IC) 654 is constituted by PLA, the oscillating portion, the diving control portion, and the motor driving portion are constituted to operate by a program stored to PLA.

The quartz unit 650 and the integrating circuit 654 are fixed to a circuit board 610. The circuit board 610, the quartz unit 650 and the integrated circuit 654 constitute a circuit block 612. A circuit block 612 is arranged on the case back side of the main plate 402. The timepiece with calendar of the invention can use outward-attached elements of a resistor, a condenser, a coil, a diode and the like as necessary. A battery terminal (−) 660 is provided for conducting a negative pole of the battery 440 and a minus pattern of the circuit board 610. A battery terminal (+) 662 is provided for conducting a positive pole of the battery 440 and a plus pattern of the circuit board 610.

A coil block 630 including a coil wire wound around a magnetic core, a stator 632 arranged to be brought into contact with both end portions of the magnetic core of the coil block 630, and a rotor 634 including a rotor magnet 634*b* arranged at the rotor hole 632*c* of the stator 632 are arranged on the case back side of the main plate 402. The coil block 630, the stator 632, and the rotor 634 constitutes the step motor. A fifth wheel & pinion 441 is constituted to rotate by rotation of the rotor 634. A fourth wheel & pinion 442 is constituted to rotate by rotation of the fifth wheel & pinion 441. A third wheel & pinion 444 is constituted to rotate by rotation of the fourth wheel & pinion 442. A center wheel & pinion 446 is constituted to rotate by rotation of the third wheel & pinion 444. A minute wheel & pinion 448 is constituted to rotate by rotation of the center wheel & pinion 446. An hour wheel & pinion 480 is constituted to rotate by rotation of the minute wheel & pinion 448.

The fourth wheel & pinion 442 is constituted to rotate by one rotation per 1 minute. A second hand 460 is attached to the fourth wheel & pinion 442. The center wheel & pinion 446 is constituted to rotate by one rotation per 1 hour. A minute hand 462 is attached to the center wheel & pinion 446. A slip mechanism is attached to the center wheel & pinion 446. When hands are set by the slip mechanism, by rotating the hand setting stem 410 in a state of stopping the second hand 460, the minute hand 462 and an hour hand 464 can be rotated. When the hands are set by pulling the hand setting stem 410 to 2 stage, in order to stop rotation of the second hand 460 by rectifying a wheel portion of the fifth wheel & pinion 441, a rectifying lever 468 is provided. A center pipe 402*c* is fixed to the main plate 402. The center pipe 402*c* is extended from the case back side of the main plate 402 to the dial side of the main plate 402. The center wheel & pinion 446 is rotatably supported at inside of a hole portion of the center pipe 402*c*. An abacus bead of the fourth wheel & pinion 442 is rotatably supported at inside of a hole portion of the center wheel & pinion 446.

A train wheel bridge 458 is arranged on the case back side of the main plate 402. An upper shaft portion of the rotor 634, an upper shaft portion of the fifth wheel & pinion 441, an upper shaft portion of the fourth wheel & pinion 442, an upper shaft portion of the third wheel & pinion 444, and an upper shaft portion of the minute wheel & pinion 448 are rotatably supported by the train wheel bridge 458. A lower shaft portion of the rotor 634, a lower shaft portion of the fifth wheel & pinion 441, a lower shaft portion of the third wheel & pinion 444, and a lower shaft portion of the minute wheel & pinion 448 are rotatably supported by the main plate 402. The hour wheel & pinion 480 is constituted to rotate by one rotation per 12 hours. The hour hand 464 is attached to the hour wheel & pinion 480. By the hour hand 464 attached to the hour wheel & pinion 480, "hour" is indicated by "12 hour system" constituting 12 hours by one turn. A wheel portion of the minute wheel & pinion 448 is constituted to be brought in mesh with the setting wheel 449. The setting wheel 449 is arranged between the main plate 402 and the train wheel bridge 458. A minute pinion (not illustrated) of the minute wheel & pinion 448 is disposed on the dial side of the main plate 402 and is constituted to be brought in mesh with an hour wheel of the hour wheel & pinion 480. A hole portion of the hour wheel 480 is rotatably supported by an outer peripheral portion of a shaft portion of the center pipe 402*c*.

(2.2) Operation of Second Embodiment:

Next, normal hand operation will be explained in the second embodiment of the timepiece with calendar mechanism according to the invention. In reference to FIG. 24 and FIG. 25, the battery 440 constitutes the power source of the timepiece. The crystal oscillator contained in the quartz unit 650 is oscillated by, for example, 32,768 Hertz. Based on the oscillation of the crystal oscillator, an oscillating portion included in the integrated circuit 654 outputs the reference signal, and the dividing control portion divides the output signal of the oscillating portion. The motor driving portion outputs the motor driving signal for driving the step motor to the coil block 630 based on the output signal of the dividing control portion. When the coil block 630 inputs the motor drive signal, the stator 632 is magnetized to rotate the rotor 634. The rotor 634 is rotated by, for example, 180 degrees per 1 second. Based on rotation of the rotor 634, the fourth wheel & pinion 442 is rotated by way of rotation of the fifth wheel & pinion 441. The fourth wheel & pinion 442 is rotated by one rotation per 1 minute. By the second hand 460 attached to the fourth wheel & pinion 442, "second" of time information is indicated. The third wheel & pinion 444 is rotated based on rotation of the fourth wheel & pinion 442.

The center wheel & pinion 446 is rotated based on rotation of the third wheel & pinion 444. A minute indicator may be used in place of the center wheel & pinion 446. The center wheel & pinion 446 is rotated by one rotation per 1 hour. By the minute hand 462 attached to the center wheel & pinion 446, "minute" of time information is indicated. The slip mechanism is attached to the center wheel & pinion 446. By the slip mechanism, when hands are set, in a state of stopping the second hand 460 by rectifying the wheel portion of the fifth wheel & pinion 442 by the rectifying lever 468, by rotating the hand setting stem 480, the minute hand 462 and the hour hand 464 can be rotated. The minute wheel & pinion 448 is rotated based on rotation of the center wheel & pinion 446. The hour wheel & pinion 480 is rotated based on rotation of the minute wheel & pinion 448. The hour wheel 480 is rotated by one rotation per 12 hours. By the hour hand 464 attached to the hour wheel & pinion 480, "hour" of time information is indicated.

According to the second embodiment of the timepiece with calendar mechanism of the invention, calendar driving operation, calendar correcting operation or the like is similar to operation of the first embodiment of the timepiece with calendar mechanism according to the invention. That is, by rotating the hour wheel & pinion 480, the date driving wheel 510 is rotated by way of rotation of the intermediate first date driving wheel 530, the intermediate second date driving wheel 531, and the date driving finger 511 rotates the program wheel & pinion 540 in the clockwise direction by the amount of one tooth by one time per 1 day. By rotating the program wheel & pinion 540, the first program wheel 544 can rotate the first date indicator 512, the second program wheel 546 can rotate the second date indicator 522, and the third program wheel 548 can rotate the third date wheel 532.

By the invention, the timepiece with calendar mechanism in which the drive mechanism for driving the date indicator is simple and an area occupied by the drive mechanism is small can be fabricated. Further, by the invention, the timepiece with calendar mechanism promoting optical recognizability of date indication by a compact constitution can be fabricated. That is, by the invention, in the timepiece with calendar mechanism, large date indication can be realized. Further, according to the timepiece with calendar mechanism of the invention, a load of rotating the drive mechanism is small.

According to the timepiece with calendar mechanism of the invention, the drive mechanism for driving the three date indicators is simple and an area occupied by the drive mechanism is small. Therefore, according to the timepiece with calendar mechanism of the invention, by the compact constitution, recognizability of date indication can simply be promoted. Further, the timepiece with calendar mechanism of the invention is provided with a structure of indicating the position of 1 of date indication by the first date indicator and the second date indicator arranged in two stages and therefore, large date indication can be realized. Further, the timepiece with calendar mechanism of the invention can be constituted to make the rotational load of the drive mechanism small. Further, according to the timepiece with calendar mechanism of the invention, a frequency of correcting date at end of month can be made to be 5 times in a year.

What is claimed is:

1. A timepiece with calendar mechanism comprising:

a drive mechanism for driving the timepiece with calendar mechanism;

a time indicator for indicating time by undergoing rotation in accordance with a driving operation of the drive mechanism;

a first date indicator having date characters and mounted to undergo intermittent rotation;

a second date indicator having date characters and mounted to undergo intermittent rotation relative to the first date indicator so that combinations of the date characters of the first and second date indicators indicate a units numeral of a date, the second date indicator having a separate and independent structure from that of the first date indicator, and the first date indicator having a notch portion for indicating the date characters of the second date indicator;

a third data indicator having date characters for indicating a tens numeral of the date; and a program wheel for intermittently rotating the first date indicator, the second date indicator, and the third date indicator in accordance with a drive operation of the drive mechanism;

wherein the timepiece with calendar mechanism indicates a date by one of the date characters of the first date indicator and one of the date characters of the third date indicator with peripheral portions of the first date indicator and the third date indicator being positioned proximate to each other, or the timepiece with calendar mechanism indicates a date by one of the date characters of the second date indicator and one of the date characters of the third date indicator with peripheral portions of the second date indicator and the third date indicator being positioned proximate to each other.

2. A timepiece with calendar mechanism according to claim 1; wherein a rotation center axis line of the first date indicator and a rotation center axis line of the second date indicator coincide with each other.

3. A timepiece with calendar mechanism according to claim 1; wherein a rotation center axis line of the program wheel coincides with a rotation center axis line of the time indicator.

4. A timepiece with calendar mechanism according to claim 1; wherein the program wheel includes a program date indicator for undergoing rotation in accordance with a drive operation of the drive mechanism, a first program wheel for undergoing rotation integrally with the program date indicator to intermittently rotate the first date indicator, a second program wheel for undergoing rotation integrally with the program date indicator to intermittently rotate the second date indicator, and a third program wheel for undergoing rotation integrally with the program date indicator to intermittently rotate the third date indicator.

5. A timepiece with calendar mechanism according to claim 4; wherein the program date indicator includes 31 pieces of tooth portions for driving engagement with the drive mechanism, the first program wheel includes 18 pieces of tooth portions for rotating the first date wheel, the second program wheel includes 18 pieces of tooth portions for rotating the second date indicator, the third program indicator includes four pieces of tooth portions for rotating the third date indicator, the first date indicator has a first date character indicating face including five numerals aligned in a peripheral direction in an order of "0", "1", "2", "3", "4", the second date indicator having a second date character indicating face including five numerals aligned in a peripheral direction in an order of "5", "6", "7", "8", "9", and the third date indicator has a third date character indicating face including four numerals aligned in a peripheral direction in an order of "0", "1", "2", "3", or three numerals aligned in the peripheral direction in an order of "1", "2", "3".

6. A timepiece with calendar mechanism according to claim 4; further comprising an intermediate date driving wheel for undergoing rotation in accordance with a drive operation of the drive mechanism and arranged to overlap the program wheel, a date driving wheel for undergoing rotation in accordance with rotation of the intermediate date driving wheel, and a date driving finger for undergoing rotation in accordance with rotation of the date driving wheel; wherein the program date indicator undergoes rotation in accordance with rotation of the date driving finger.

7. A timepiece with calendar mechanism according to claim 4; further comprising a program date indicator jumper for rectifying rotation of the program date indicator, a first date indicator jumper for rectifying rotation of the first date indicator, a second date indicator jumper for rectifying rotation of the second date indicator, and a third date indicator jumper for rectifying rotation of the third date indicator.

8. A timepiece with calendar mechanism according to claim 4; wherein the program date wheel includes a tooth portion for driving engagement with the drive mechanism, the first program wheel includes a tooth portion for rotating the first date indicator, the second program wheel includes a tooth portion for rotating the second date indicator, the third program wheel includes a tooth portion for rotating the third date indicator, the first date indicator has a first date character indicating face including one piece or two consecutive pieces or more and eight consecutive pieces or less of numerals constituted by aligning numerals of "0", "1", "2", "3", "4", "5", "6", "7", "8", "9" in a peripheral direction, the second date indicator includes a second date character indicating face aligned with all of the consecutive numerals "0", "1", "2", "3", "4", "5", "6", "7", "8", "9" in a peripheral direction other than the numerals aligned at the first date indicator, and the third date indicator includes a third character indicating face including numerals aligned in a peripheral direction in an order of "0", "1", "2", "3", or numerals aligned in the peripheral direction in an order of "1", "2", "3".

9. A timepiece with calendar mechanism according to claim 8; wherein the program date wheel includes 31×n pieces of tooth portions for driving engagement with the drive mechanism, where n is a natural number equal to or larger than 1, and the third date wheel includes a wheel having a number of teeth equal to or smaller than a number of teeth of the first date indicator or the second date indicator.

10. A timepiece with calendar mechanism according to claim 1; further comprising a hand setting stem mounted for undergoing axial movement to a hand setting stem position and for undergoing rotation while in the hand setting stem position to correct calendar information, and a calendar correcting mechanism for correcting a display content of the first date indicator, a display content of the second date indicator, and a display content of the third date indicator by rotating the hand setting stem in a state in which the hand setting stem is in the hand setting stem position, the calendar correcting mechanism including a calendar correcting wheel that rotates the program wheel in accordance with rotation of the hand setting stem in the state in which the hand setting stem is in the hand setting stem position.

11. A timepiece with calendar mechanism according to claim 1; wherein the first, second and third date indicators comprise separate and independent wheels.

12. A timepiece with calendar mechanism according to claim 11; wherein all of the wheels have the same outer diameter.

13. A timepiece with calendar mechanism according to claim 1; wherein each of the first, second and third date indicators comprises a date plate having the corresponding date characters.

14. A timepiece with calendar mechanism comprising:

a drive mechanism;

a time indicator that indicates time by undergoing rotation in accordance with a driving operation of the drive mechanism;

first and second separate and independent date indicators each having date characters and each mounted to undergo intermittent rotation so that combinations of the date characters of the first and second date indicators indicate a units numeral of a date, the first date indicator having a notch portion for indicating the date characters of the second date indicator;

a third date indicator having date characters and mounted to undergo rotation for indicating a tens numeral of the date; and a program wheel for intermittently rotating the first, second and third date indicators in accordance with a driving operation of the drive mechanism.

15. A timepiece with calendar mechanism according to claim 14; wherein each of the first, second and third date indicators comprises a date plate having the corresponding date characters.

16. A timepiece with calendar mechanism according to claim 14; wherein a rotation center axis line of the first date indicator and a rotation center axis line of the second date indicator coincide with each other.

17. A timepiece with calendar mechanism according to claim 14; wherein a rotation center axis line of the program wheel coincides with a rotation center axis line of the time indicator.

18. A timepiece with calendar mechanism according to claim 14; wherein the program wheel includes a program date indicator for undergoing rotation in accordance with a drive operation of the drive mechanism, a first program wheel for undergoing rotation integrally with the program date indicator to intermittently rotate the first date indicator, a second program wheel for undergoing rotation integrally with the program date indicator to intermittently rotate the second date indicator, and a third program wheel for undergoing rotation integrally with the program date indicator to intermittently rotate the third date indicator.

19. A timepiece with calendar mechanism according to claim 18; further comprising a program date indicator jumper for rectifying rotation of the program date indicator, a first date indicator jumper for rectifying rotation of the first date indicator, a second date indicator jumper for rectifying rotation of the second date indicator, and a third date indicator jumper for rectifying rotation of the third date indicator.

20. A timepiece with calendar mechanism according to claim 14; wherein peripheral portions of the first date indicator and the third date indicator are positioned proximate to each other so that the timepiece with calendar mechanism indicates a date by one of the date characters of the first date indicator and one of the date characters of the third date indicator.

21. A timepiece with calendar mechanism according to claim 14; wherein peripheral portions of the second date indicator and the third date indicator are positioned proximate to each other so that the timepiece with calendar mechanism indicates a date by one of the date characters of the second date indicator and one of the date characters of the third date indicator.

22. A timepiece with calendar mechanism comprising:

a drive mechanism;

a time indicator that indicates time by undergoing rotation in accordance with a driving operation of the drive mechanism;

first and second date wheels each having date characters and each mounted to undergo intermittent rotation so that combinations of the date characters of the first and second date wheels indicate a units numeral of a date, the first date wheel having a notch portion for indicating the date characters of the second date wheel;

a third date wheel having date characters and mounted to undergo rotation for indicating a tens numeral of the date; and a program wheel for intermittently rotating the first, second and third date wheels in accordance with a driving operation of the drive mechanism.

23. A timepiece with calendar mechanism according to claim 22; wherein each of the first, second and third date wheels comprises a date plate having the corresponding date characters.

24. A timepiece with calendar mechanism according to claim 22; wherein a rotation center axis line of the first date wheel and a rotation center axis line of the second date wheel coincide with each other.

25. A timepiece with calendar mechanism according to claim 22; wherein a rotation center axis line of the program wheel coincides with a rotation center axis line of the time indicator.

26. A timepiece with calendar mechanism according to claim 22; wherein the program wheel includes a program date indicator for undergoing rotation in accordance with a drive operation of the drive mechanism, a first program wheel for undergoing rotation integrally with the program date indicator to intermittently rotate the first date wheel, a second program wheel for undergoing rotation integrally with the program date indicator to intermittently rotate the second date wheel, and a third program wheel for undergoing rotation integrally with the program date indicator to intermittently rotate the third date wheel.

27. A timepiece with calendar mechanism according to claim 26; further comprising a program date indicator jumper for rectifying rotation of the program date indicator, a first date indicator jumper for rectifying rotation of the first date wheel, a second date indicator jumper for rectifying rotation of the second date wheel, and a third date indicator jumper for rectifying rotation of the third date wheel.

28. A timepiece with calendar mechanism according to claim 22; wherein peripheral portions of the first date wheel and the third date wheel are positioned proximate to each other so that the timepiece with calendar mechanism indicates a date by one of the date characters of the first date wheel and one of the date characters of the third date wheel.

29. A timepiece with calendar mechanism according to claim 22; wherein peripheral portions of the second date wheel and the third date wheel are positioned proximate to each other so that the timepiece with calendar mechanism indicates a date by one of the date characters of the second date wheel and one of the date characters of the third date wheel.

* * * * *